US011849289B2

(12) United States Patent
Ko et al.

(10) Patent No.: US 11,849,289 B2
(45) Date of Patent: Dec. 19, 2023

(54) ELECTRONIC DEVICE FOR OUTPUTTING SOUND AND METHOD FOR OPERATING THE SAME

(71) Applicant: SAMSUNG ELECTRONICS CO., LTD., Suwon-si (KR)

(72) Inventors: Seunghwan Ko, Suwon-si (KR); Seonghun Jeong, Suwon-si (KR); Kiyean Kim, Suwon-si (KR); Dongjin Kim, Suwon-si (KR); Yeongkwan Kim, Suwon-si (KR); Joonho Kim, Suwon-si (KR); Taeseon Kim, Suwon-si (KR); Hyeonhyang Kim, Suwon-si (KR); Jungkeun Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 120 days.

(21) Appl. No.: 17/471,943

(22) Filed: Sep. 10, 2021

(65) Prior Publication Data

US 2022/0086578 A1 Mar. 17, 2022

(30) Foreign Application Priority Data

Sep. 11, 2020 (KR) ..... 10-2020-0117023

(51) Int. Cl.
*H04R 29/00* (2006.01)
*H04R 1/10* (2006.01)

(52) U.S. Cl.
CPC ..... *H04R 29/001* (2013.01); *H04R 1/1016* (2013.01); *H04R 29/004* (2013.01); *H04R 2420/07* (2013.01)

(58) Field of Classification Search
CPC .. H04R 29/001; H04R 1/1016; H04R 29/004; H04R 2420/07

(Continued)

(56) References Cited

U.S. PATENT DOCUMENTS 10,764,699 B1 * 9/2020 Rule ..... G10K 11/17823
2007/0172072 A1 * 7/2007 Yang ..... H04R 29/00 381/59

(Continued)

FOREIGN PATENT DOCUMENTS

EP 3905721 A1 * 11/2021
JP 2013-502116 1/2013

(Continued)

OTHER PUBLICATIONS

International Search Report and Written Opinion dated Dec. 22, 2021 in corresponding International Application No. PCT/KR2021/012414.

(Continued)

*Primary Examiner* — Vivian C Chin
*Assistant Examiner* — Con P Tran
(74) *Attorney, Agent, or Firm* — Nixon & Vanderhye P.C.

(57) ABSTRACT

According to an embodiment, an electronic device comprises a memory, a communication module, a first speaker including at least one vibration component, at least one first microphone, and a processor configured to output a first sound having a predetermined frequency via the first speaker when a closed space is formed with the electronic device mounted on a cradle, obtain a third sound, which is a reflection of the first sound in the closed space, via the at least one first microphone, obtain a fourth sound, which is a reflection of a second sound in the closed space, via the at least one first microphone, the second sound output from a second speaker included in an external electronic device located in the closed space, and identify whether the performance of the first speaker, the at least one first microphone, and the second speaker is normal, based on the third sound and the fourth sound.

15 Claims, 17 Drawing Sheets

(58) Field of Classification Search
USPC ..... 381/58, 59, 56, 61, 96, 95, 98, 62, 63, 381/355, 332, 87, 122
See application file for complete search history.

(56) References Cited

U.S. PATENT DOCUMENTS

| | | | | |
|---|---|---|---|---|
| 2007/0286429 | A1* | 12/2007 | Grafenberg | H04R 25/30 381/60 |
| 2012/0140963 | A1 | 6/2012 | Larsen et al. | |
| 2015/0124985 | A1 | 5/2015 | Kim | |
| 2018/0227659 | A1 | 8/2018 | Kumar et al. | |
| 2019/0110121 | A1 | 4/2019 | Sapozhnykov et al. | |
| 2020/0204898 | A1 | 6/2020 | Schoeck et al. | |
| 2021/0127221 | A1* | 4/2021 | Kannan | H04R 25/30 |

FOREIGN PATENT DOCUMENTS

| | | |
|---|---|---|
| KR | 20-2009-0001130 | 2/2009 |
| KR | 10-2062209 | 12/2019 |
| KR | 10-2071268 | 1/2020 |
| KR | 10-2020-0070290 | 6/2020 |

OTHER PUBLICATIONS

European Search Report dated Sep. 25, 2023 for EP Application No. 21867184.0.

* cited by examiner

| SPEAKER 1 | | SPEAKER 2 | | COMPONENT WITH ABNORMAL PERFORMANCE |
|---|---|---|---|---|
| MICROPHONE 1 | MICROPHONE 2 | MICROPHONE 1 | MICROPHONE 2 | |
| O | O | O | O | ALL NORMAL |
| O | O | X | X | SPEAKER 2 |
| X | X | O | O | SPEAKER 1 |
| O | X | O | X | MICROPHONE 2 |
| X | O | X | O | MICROPHONE 1 |
| O | X | X | X | SPEAKER 2 & MICROPHONE 2 |
| X | O | X | X | SPEAKER 2 & MICROPHONE 1 |
| X | X | O | X | SPEAKER 1 & MICROPHONE 2 |
| X | X | X | O | SPEAKER 1 & MICROPHONE 1 |

400

410

420

FIG.4

| KIND OF FOREIGN BODY | FREQUENCY BAND | REFERENCE DATA | THRESHOLD |
|---|---|---|---|
| WATER | 15000 Hz | -60 dB | 2 dB |
| STARCH | 375 Hz | -54 dB | 1 dB |
| STONE | 12000 Hz | -50 dB | 5 dB |
| WATER+STONE | 9000 Hz | -60 dB | 10 dB |

FIG.9A

| FREQUENCY BAND | REFERENCE DATA | WATER | STARCH | THRESHOLD |
|---|---|---|---|---|
| 375 Hz | -54 dB | -34 dB | -52 dB | 1 dB |
| 3234 Hz | -32 dB | -26 dB | -32 dB | 3 dB |
| 9890 Hz | -47 dB | -31 dB | -48 dB | 10 dB |

FIG.9B

ELECTRONIC DEVICE FOR OUTPUTTING SOUND AND METHOD FOR OPERATING THE SAME

CROSS-REFERENCE TO RELATED APPLICATION(S)

This application is based on and claims priority under 35 U.S.C. 119 to Korean Patent Application No. 10-2020-0117023, filed on Sep. 11, 2020, in the Korean Intellectual Property Office, the disclosure of which is herein incorporated by reference in its entirety.

BACKGROUND

Field

Various embodiments of the disclosure relate to electronic devices for outputting sound and methods for operating the same.

Description of Related Art

As wireless communication technology advances, an electronic device may communicate with another electronic device via various wireless communication techniques. Bluetooth communication technology means short-range wireless communication technology that may interconnect electronic devices to exchange data or information. Bluetooth communication technology may have Bluetooth legacy (or classic) network technology or Bluetooth low energy (BLE) network technology and have various kinds of topology, such as piconet or scatternet. Electronic devices may share data at low power using Bluetooth communication technology. Such Bluetooth technology may be used to connect external wireless communication devices and transmit audio data for the content running on the electronic device to an external wireless communication device so that the external wireless communication device may process the audio data and output the result to the user. Bluetooth communication technology-adopted wireless earphones are recently in wide use. For a better performance, wireless earphones with multiple microphones are used.

SUMMARY

Earphones with multiple microphones and speakers have a high chance of a microphone or speaker malfunction. Such malfunction may result to a poor performance of the wireless earphones. For example, the user of the wireless earphones may feel uncomfortable in talking on the earphones. As such, calling on the earphones may not work normally.

The user goes to a service center to check any malfunction of a microphone in the earphones. Thus, inconvenience exists in checking the presence or cause of a malfunction of the microphone or speaker in the earphones.

According to various embodiments, there may be provided an electronic device capable of identifying whether a speaker and microphone included in an earphone properly works even without visiting a service center and a method for operating the electronic device.

In accordance with an embodiment, an electronic device comprises a memory, a communication module, a first speaker including at least one vibration component, at least one first microphone, and a processor configured to output a first sound having a predetermined frequency via the first speaker when a closed space is formed with the electronic device mounted on a cradle, obtain a third sound, which is a reflection of the first sound in the closed space, via the at least one first microphone, obtain a fourth sound, which is a reflection of a second sound in the closed space, via the at least one first microphone, the second sound output from a second speaker included in an external electronic device located in the closed space, and identify whether a performance of the first speaker, the at least one first microphone, and the second speaker is normal, based on the third sound and the fourth sound.

In accordance with an embodiment, a method for operating an electronic device comprises outputting a first sound having a predetermined frequency via a first speaker included in the electronic device when a closed space is formed with the electronic device mounted on a cradle, obtaining a third sound, which is a reflection of the first sound in the closed space, via at least one first microphone included in the electronic device, obtaining a fourth sound, which is a reflection of a second sound in the closed space, via the at least one first microphone, the second sound output from a second speaker included in an external electronic device located in the closed space, and identifying whether a performance of the first speaker, the at least one first microphone, and the second speaker is normal, based on the third sound and the fourth sound.

In accordance with an embodiment, there is provided a computer-readable recording medium storing a program, the program comprising outputting a first sound having a predetermined frequency via a first speaker included in the electronic device when a closed space is formed with the electronic device mounted on a cradle, obtaining a third sound, which is a reflection of the first sound in the closed space, via at least one first microphone included in the electronic device, obtaining a fourth sound, which is a reflection of a second sound in the closed space, via the at least one first microphone, the second sound output from a second speaker included in an external electronic device located in the closed space, identifying whether a performance of the first speaker, the at least one first microphone, and the second speaker is normal, based on the third sound and the fourth sound, obtaining, from the external electronic device, information indicating whether the performance of the first speaker, the second speaker, and at least one second microphone included in the external electronic device is normal, as identified by the external electronic device, and identifying whether the performance of the first speaker, the at least one first microphone, the second speaker, and the at least one second microphone is normal, based on the obtained information.

Other aspects, advantages, and salient features of the disclosure will become apparent to those skilled in the art from the following detailed description, which, taken in conjunction with the annexed drawings, discloses exemplary embodiments of the disclosure.

BRIEF DESCRIPTION OF THE DRAWINGS

A more complete appreciation of the disclosure and many of the attendant aspects thereof will be readily obtained as the same becomes better understood by reference to the following detailed description when considered in connection with the accompanying drawings, wherein:

FIG. 4 is a view illustrating a method for identifying whether the performance of a speaker and a microphone is normal, by an electronic device, according to an embodiment;

FIGS. 9A and 9B are views illustrating the operation of providing information about a foreign matter by an electronic device according to an embodiment;

Throughout the drawings, like reference numerals will be understood to refer to like parts, components, and structures.

DETAILED DESCRIPTION

Figure 1:
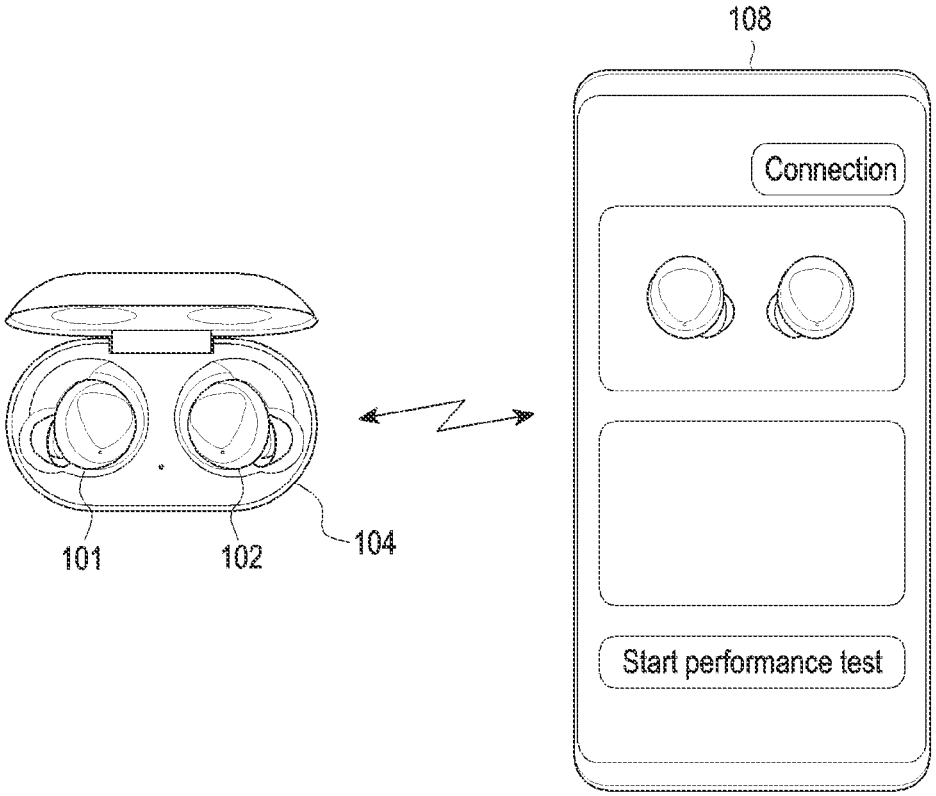
FIG. 1 is a view illustrating an electrical system according to an embodiment.

FIG. 1 is a view illustrating an electrical system according to an embodiment.

Referring to FIG. 1, an electronic system may include a first electronic device 101, a second electronic device 102, a third electronic device 104, and a fourth electronic device 108. For example, each of the first electronic device 101, the second electronic device 102, the third electronic device 104, and the fourth electronic device 108 may transmit/receive data to/from another via short-range communication technology (e.g., Bluetooth communication technology). For example, the first electronic device 101 and the second electronic device 102 may transmit/receive data using wireless communication technology. The first electronic device 101 may directly transmit/receive data to/from the third electronic device 104 and/or the fourth electronic device 108. The second electronic device 102 may directly transmit/receive data to/from the third electronic device 104 and/or the fourth electronic device 108.

According to an embodiment, the first electronic device 101 and the second electronic device 102 may be implemented as earphones to wirelessly output sound. For example, the first electronic device 101 and the second electronic device 102 may convert the data received from the fourth electronic device 108 into a sound and output the converted sound (e.g., music). The first electronic device 101 and the second electronic device 102 may obtain an external sound (e.g., the user's voice) and transmit the data corresponding to the obtained sound to the fourth electronic device 108. For example, the first electronic device 101 and the second electronic device 102 may be implemented to be worn on the user's right and left ears, respectively. For example, the first electronic device 101 may be a primary device (also referred to as a primary piece of equipment), and the second electronic device 102 may be a secondary device (also referred to as a secondary piece of equipment). For example, the first electronic device 101 may form a communication link with the fourth electronic device 108. The first electronic device 101 may transmit the information obtained by the first electronic device 101 and the information received from the second electronic device 102 to the fourth electronic device 108 via the communication link.

According to an embodiment, the first electronic device 101 and the second electronic device 102 may be mounted on the third electronic device 104. For example, the third electronic device 104 may be implemented as a cradle for mounting the first electronic device 101 and the second electronic device 102. For example, the third electronic device 104 may (wirelessly or wiredly) transmit power to the first electronic device 101 and the second electronic device 102, with the first electronic device 101 and the second electronic device 102 mounted thereon. In other words, the third electronic device 104 may charge the first electronic device 101 and the second electronic device 102.

According to an embodiment, the third electronic device 104 may identify whether the first electronic device 101 and the second electronic device 102 are mounted. For example, when the first electronic device 101 and the second electronic device 102 contact the charging terminals included in the third electronic device 104, the third electronic device 104 may determine that the first electronic device 101 and the second electronic device 102 are mounted.

According to an embodiment, the third electronic device 104 may transmit a notification signal indicating whether the cover (e.g., the lid of the third electronic device 104) is open or closed, with the first electronic device 101 and the second electronic device 102 mounted. For example, the third electronic device 104 may transmit a notification signal to the first electronic device 101 and/or the second electronic device 102 when the cover is closed or open. For example, the notification signal may mean a signal indicating the open/closed state of the cover. For example, the third electronic device 104 may identify the closed state (or open state) of the cover by detecting a magnetic force by a magnet included in the cover, via a hall sensor. The third electronic device 104 may detect that the illuminance is lowered to a predetermined level as the cover is closed, using an illuminance sensor, thereby identifying the closed state (or open state) of the cover. For example, when the cover is in the closed state, the first electronic device 101 and second electronic device 102 mounted on the third electronic device 104 may be positioned in a closed space.

According to an embodiment, when a closed space is formed, with the first electronic device 101 and the second electronic device 102 mounted on the third electronic device 104, the first electronic device 101 and the second electronic device 102 may identify whether the performance of the speaker and microphone included in each of the first electronic device 101 and the second electronic device 102 is normal. The first electronic device 101 and the second electronic device 102 may identify the cause of performance deterioration of the speaker and microphone included in each of the first electronic device 101 and the second electronic device 102. The operations of the first electronic device 101 and the second electronic device 102 are described below in detail with reference to FIG. 2.

According to an embodiment, the fourth electronic device 108 may be implemented as a computing device (e.g., a smartphone or personal computer (PC)) capable of performing communication functions. For example, the fourth electronic device 108 may transmit/receive data to/from the first electronic device 101, the second electronic device 102, and the third electronic device 104. For example, the fourth electronic device 108 may transmit a command for performing a specific function to the first electronic device 101 and the second electronic device 102. For example, the fourth electronic device 108 may transmit a command for controlling to perform the operation of identifying whether the performance of the microphone and speaker included in each of the first electronic device 101 and the second electronic device 102 is normal to the first electronic device 101 and the second electronic device 102. The fourth electronic device 108 may receive information indicating the state (e.g., the state of the speaker and microphone) of the first electronic device 101 and the second electronic device 102.

Figure 2:
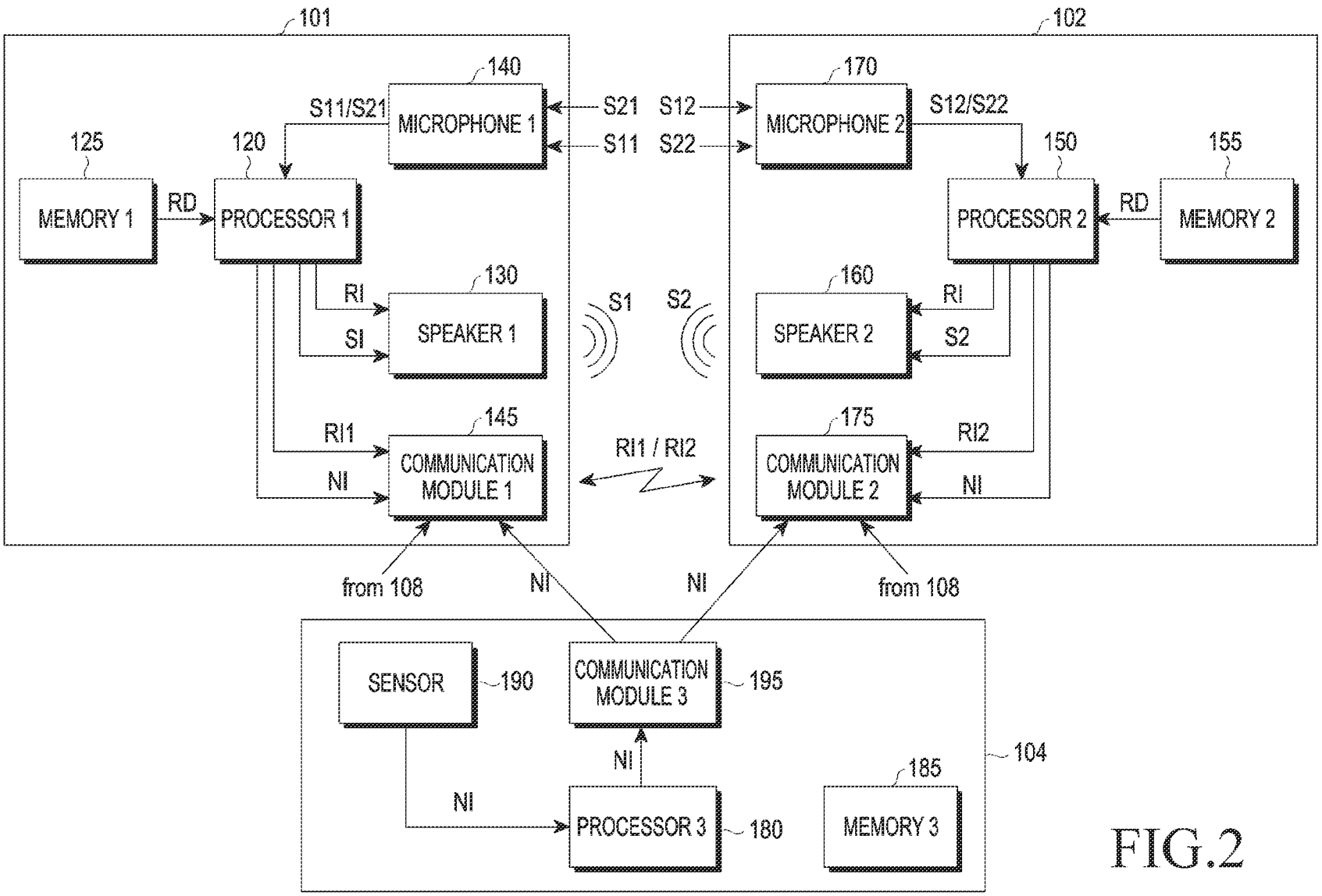
FIG. 2 is a block diagram illustrating an electronic system according to an embodiment.

FIG. 2 is a block diagram illustrating an electronic system according to an embodiment.

Referring to FIG. 2, the first electronic device 101 may include a first processor 120, a first memory 125, a first speaker 130, a first microphone 140, and a first communication module 145.

According to an embodiment, the first processor 120 may control the overall operation of the first electronic device 101. The first processor 120 may transmit/receive data to/from the second electronic device 102, the third electronic device 104, and the fourth electronic device 108 via the first communication module 145. For example, the first communication module 145 may support wireless communication technology (e.g., Bluetooth communication technology).

According to an embodiment, the first processor 120 may receive a notification signal NI indicating whether the cover of the third electronic device 104 is in the closed state (or open state), from the third electronic device 104. When the cover of the third electronic device 104 is in the closed state, the first electronic device 101 mounted on the third electronic device 104 may be located in the closed space.

According to an embodiment, when the closed space is formed, with the first electronic device 101 mounted on the third electronic device 104, the first processor 120 may output a first signal S1 having a predetermined frequency via the first speaker 130, in response to a trigger signal. For example, the trigger signal may be a signal for starting the operation of identifying, by the first electronic device 101, whether the performance of the first speaker 130 and the first microphone 140 is normal. The trigger signal may be generated by the first processor 120 itself or may be received from the second electronic device 102, the third electronic device 104, or the fourth electronic device 108. For example, the first sound S1 may be a sound having a frequency in several frequency bands having the audible frequency. For example, the first sound S1 may include various noises. For example, the first sound S1 may include at least one of pink noise, brown noise, or white noise.

According to an embodiment, the first processor 120 may output the first sound S1 from the first speaker 130, before the second sound S2 is output from the second speaker 160, based on the trigger signal. The first processor 120 may output the first sound S1 from the first speaker 130, after the second sound S2 is output from the second speaker 160, based on the trigger signal. In other words, the first processor 120 may control the first speaker 130 to allow the first sound S1 and the second sound S2 not to be simultaneously output, based on the trigger signal. For example, the trigger signal may include information about the time when the first processor 120 outputs the first sound S1 from the first speaker 130.

According to an embodiment, the first processor 120 may obtain the third sound S11, which is a reflection of the first sound S1 in the closed space of the third electronic device 104 (e.g., a cradle), via the first microphone 140. For example, the third sound S11 may be a sound resultant as the first sound S1 output via the first speaker 130 is reflected in the closed space of the third electronic device 104 and is obtained via the first microphone 140.

According to an embodiment, the first processor 120 may obtain the fourth sound S21 which is a reflection, in the closed space of the third electronic device 104, of the second sound S2, output from the second electronic device 102 (or the second speaker 160) mounted on the third electronic device 104 (e.g., a cradle), via the first microphone 140. For example, the second sound S2 may be a sound having a frequency in several frequency bands including the audible frequency. For example, the second sound S2 may include various noises. For example, the second sound S2 may include at least one of pink noise, brown noise, or white noise. For example, the second sound S2 may be implemented as the same sound as the first sound S1 or a sound different from the first sound S1. For example, the fourth sound S21 may be a sound resultant as the second sound S2 output via the second speaker 160 of the second electronic device 102 is reflected in the closed space of the third electronic device 104 and is obtained via the first microphone 140.

According to an embodiment, the first processor 120 may sequentially obtain the third sound S11 and the fourth sound S21 via the first microphone 140. The first processor 120 may obtain reference data RD from the first memory 125 to analyze the third sound S11 and the fourth sound S21. For example, the reference data RD may be data obtained when the performance of the speakers 130 and 160 and microphones 140 and 170 included in the first electronic device 101 and the second electronic device 102 is normal. For example, the reference data RD may include information about a plurality of reference signals according to combinations of the speakers 130 and 160 and microphones 140 and 170 of the first electronic device 101 and the second electronic device 102.

According to an embodiment, the first processor 120 may compare a first reference signal with a signal corresponding to the third sound S11. For example, the first reference signal may be a reference signal according to a combination of the first speaker 130 and the first microphone 140. The first processor 120 may compare the first reference signal with a signal corresponding to the third sound S11 in at least one specific frequency band and identify whether the performance of the first speaker 130 and/or the first microphone 140 is degraded according to the result of comparison. The first processor 120 may identify whether the performance of the first speaker 130 and/or the first microphone 140 is degraded according to the result of comparison.

Figure 3:
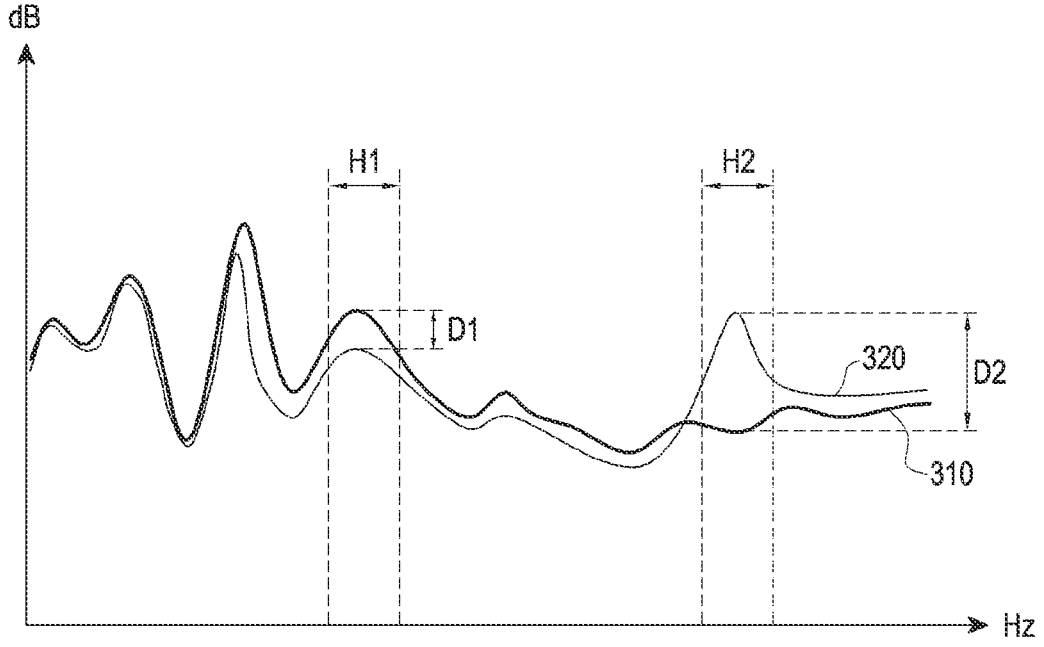
FIG. 3 is a view illustrating a method for comparing a reference signal with a signal corresponding to a sound obtained by an electronic device according to an embodiment.

For example, referring to FIG. 3, the first processor 120 may compare the first reference signal 310 with the first signal 320 corresponding to the third sound S11. The first processor 120 may obtain a first difference D1 between the first signal 320 and the first reference signal 310 in a first frequency band H1. The first processor 120 may compare the first difference D1 with a first threshold and, when the first difference D1 is larger than the first threshold, determine that the performance of at least one of the first speaker 130 and the first microphone 140 is degraded. The first processor 120 may determine that the performance of at least one of the first speaker 130 and the first microphone 140 is degraded due to a foreign matter (e.g., water) corresponding to the first frequency band H1. The first threshold may be a reference value for determining whether the performance of the first speaker 130 and the first microphone 140 is normal in the first frequency band H1. For example, the first threshold may be a constant or may be a ratio relative to a reference value. For example, when the magnitude of signal at a specific frequency is different from the reference value by a specific ratio or more, the first processor 120 may determine that the performance is abnormal.

For example, the first processor 120 may obtain a second difference D2 between the first signal 320 and the first reference signal 310 in a second frequency band H2. The first processor 120 may compare the second difference D2 with a second threshold and, when the second difference D2 is larger than the second threshold, determine that the performance of at least one of the first speaker 130 and the first microphone 140 is degraded. The first processor 120 may determine that the performance of at least one of the first speaker 130 and the first microphone 140 is degraded due to a foreign matter (e.g., stone) corresponding to the second frequency band H2. For example, the second threshold may be a reference value for determining whether the performance of the first speaker 130 and the first microphone 140 is normal in the second frequency band H2. For example, the second threshold may be a constant or may be a ratio relative to a reference value. For example, when the magnitude of signal at a specific frequency is different from the reference value by a specific ratio or more, the second processor 150 may determine that the performance is abnormal.

For example, when the first difference D1 is not larger than the first threshold, and the second difference D2 is not larger than the second threshold, the first processor 120 may determine that the performance of the first speaker 130 and the first microphone 140 is normal.

According to an embodiment, the first processor 120 may compare a second reference signal with a signal corresponding to the fourth sound S21. For example, the second reference signal may be a reference signal according to a combination of the second speaker 160 and the first microphone 140. The first processor 120 may compare the second reference signal with a signal corresponding to the fourth sound S21 in at least one specific frequency band and identify whether the performance of the second speaker 160 and/or the first microphone 140 is degraded according to the result of comparison. The first processor 120 may identify the cause of performance degradation of the second speaker 160 and/or the first microphone 140 according to the result of comparison. For example, the method for comparing the second reference signal with the signal corresponding to the fourth sound S21 and identifying whether the performance of the second speaker 160 and/or the first microphone 140 is degraded may be performed in the same fashion as that described above in connection with FIG. 3.

According to an embodiment, when the user first uses the first electronic device 101, the first processor 120 may obtain the data waveform (or data related to waveform corresponding to the sound) corresponding to the sound output from each of the first speaker 130 and the second speaker 160, via the first microphone 140, with the third electronic device 104 (e.g., a cradle) in the closed state. The first processor 120 may determine the first reference signal and the second reference signal based on the obtained data waveform. The first processor 120 may store the first reference signal and the second reference signal in the memory 125.

According to an embodiment, the first processor 120 may obtain first result information RI1 indicating the performance of the first speaker 130, the second speaker 160, and the first microphone 140. The first processor 120 may transmit the first result information RI1 to the second electronic device 102. The first processor 120 may receive second result information RI2 or final result information RI from the second electronic device 102. For example, the first result information RI1 may be result information obtained by the first electronic device 101, and the second result information RI2 may be result information obtained by the second electronic device 102. For example, when the first processor 120 receives the second result information RI2, the first processor 120 may obtain the final result information RI based on the first result information RI1 and the second result information RI2.

According to an embodiment, the first processor 120 may output a voice corresponding to the final result information RI via the first speaker 130. For example, upon identifying that the user wears the first electronic device 101 using a pressure sensor (not shown), the first processor 120 may output the voice corresponding to the final result information RI via the first speaker 130.

According to an embodiment, the first speaker 130 may include at least one vibration component. For example, when the first speaker 130 includes a plurality of vibration components, each of the plurality of vibration components may output a different frequency band of sound. The first processor 120 may output the first sound S1 via at least one of the plurality of vibration components. In this case, the first processor 120 may obtain the first result information indicating the performance of the first microphone 140, the second speaker 160, and at least one vibration component included in the first speaker 130 by the above-described method.

Although FIG. 2 illustrates that the first electronic device 101 includes the first microphone 140 alone, this is merely for ease of description, and the technical spirit of the disclosure may not be limited thereto. For example, the first electronic device 101 may include a plurality of microphones. In this case, the first processor 120 may obtain the first result information indicating the performance of the first speaker 130, the second speaker 160, and the plurality of microphones by the above-described method.

According to an embodiment, the second electronic device 102 may include a second processor 150, a second memory 155, a second speaker 160, a second microphone 170, and a second communication module 175.

According to an embodiment, the second processor 150 may control the overall operation of the second electronic device 102. The second processor 150 may transmit/receive data to/from the first electronic device 101, the third electronic device 104, and the fourth electronic device 108 via the second communication module 175. For example, the second communication module 145 may support wireless communication technology (e.g., Bluetooth communication technology).

According to an embodiment, the second processor 150 may receive a notification signal NI indicating whether the cover of the third electronic device 104 is in the closed state (or open state), from the third electronic device 104. When the cover of the third electronic device 104 is in the closed state, the second electronic device 102 mounted on the third electronic device 104 may be located in the closed space.

According to an embodiment, when the closed space is formed, with the second electronic device 102 mounted on the third electronic device 104, the second processor 150 may output a second signal S2 having a predetermined frequency via the second speaker 160, in response to a trigger signal. For example, the trigger signal may be a signal for starting the operation of identifying, by the second electronic device 102, whether the performance of the second speaker 160 and the second microphone 170 is normal. The trigger signal may be generated by the second processor 150 itself or may be received from the first electronic device 101, the third electronic device 104, or the fourth electronic device 108.

According to an embodiment, the second processor 150 may output the second sound S2 from the second speaker 160, after the first sound S1 is output from the first speaker 130, based on the trigger signal. The second processor 150 may output the second sound S2 from the second speaker 160, before the first sound S1 is output from the first speaker 130, based on the trigger signal. In other words, the second processor 150 may control the second speaker 150 to allow the first sound S1 and the second sound S2 not to be simultaneously output, based on the trigger signal. For example, the trigger signal may include information about the time when the second processor 150 outputs the second sound S2 from the second speaker 160.

According to an embodiment, the second processor 150 may obtain the fifth sound S22, which is a reflection of the second sound S2 in the closed space of the third electronic device 104 (e.g., a cradle), via the second microphone 170. For example, the fifth sound S22 may be a sound resultant as the second sound S2 output via the second speaker 160 is reflected in the closed space of the third electronic device 104 and is obtained via the second microphone 170.

According to an embodiment, the second processor 150 may obtain the sixth sound S12 which is a reflection, in the closed space of the third electronic device 104, of the first sound S1, output from the first electronic device 102 (or the first speaker 130) mounted on the third electronic device 104 (e.g., a cradle), via the second microphone 170. For example, the sixth sound S12 may be a sound resultant as the first sound S1 output via the first speaker 130 is reflected in the closed space of the third electronic device 104 and is obtained via the second microphone 170.

According to an embodiment, the second processor 150 may sequentially obtain the fifth sound S22 and the sixth sound S12 via the second microphone 170. The second processor 150 may obtain reference data RD from the second memory 155 to analyze the fifth sound S22 and the sixth sound S12. For example, the reference data RD may include information about a plurality of reference signals according to combinations of the speakers 130 and 160 and microphones 140 and 170 of the first electronic device 101 and the second electronic device 102.

According to an embodiment, the second processor 150 may compare a third reference signal with a signal corresponding to the fifth sound S22. For example, the third reference signal may be a reference signal according to a combination of the second speaker 160 and the second microphone 170. The second processor 150 may compare the third reference signal with a signal corresponding to the fifth sound S22 in at least one specific frequency band and identify whether the performance of the second speaker 160 and/or the second microphone 170 is degraded according to the result of comparison. The second processor 150 may identify the cause of performance degradation of the second speaker 160 and/or the second microphone 170 according to the result of comparison. For example, the method for comparing the third reference signal with the signal corresponding to the fifth sound S22 and identifying whether the performance of the second speaker 160 and/or the second microphone 170 is degraded may be performed in the same fashion as that described above in connection with FIG. 3.

According to an embodiment, the second processor 150 may compare a fourth reference signal with a signal corresponding to the sixth sound S12. For example, the fourth reference signal may be a reference signal according to a combination of the first speaker 130 and the second microphone 170. The second processor 150 may compare the fourth reference signal with a signal corresponding to the sixth sound S12 in at least one specific frequency band and identify whether the performance of the first speaker 130 and/or the second microphone 170 is degraded according to the result of comparison. The second processor 150 may identify the cause of performance degradation of the first speaker 130 and/or the second microphone 170 according to the result of comparison. For example, the method for comparing the fourth reference signal with the signal corresponding to the sixth sound S12 and identifying whether the performance of the first speaker 130 and/or the second microphone 170 is degraded may be performed in the same fashion as that described above in connection with FIG. 3.

According to an embodiment, when the user first uses the second electronic device 102, the second processor 150 may obtain the data waveform corresponding to the sound output from each of the first speaker 130 and the second speaker 160, via the first microphone 170, with the third electronic device 104 (e.g., a cradle) in the closed state. The second processor 150 may determine the third reference signal and the fourth reference signal based on the obtained data waveform. The second processor 150 may store the third reference signal and the fourth reference signal in the memory 155.

According to an embodiment, the second processor 150 may obtain second result information RI2 indicating the performance of the first speaker 130, the second speaker 160, and the second microphone 140. The second processor 150 may transmit the second result information RI2 to the first electronic device 101. The second processor 150 may receive the first result information RI1 or final result information RI from the first electronic device 101. For example, when the second processor 150 receives the first result information RI1, the second processor 150 may obtain the final result information RI based on the first result information RI1 and the second result information RI2.

For example, referring to FIG. 4, the second processor 150 may obtain result values between the first speaker 130, the second speaker 160, the first microphone 140, and the second microphone 170, based on the first result information RI1 and the second result information RI2. The second processor 150 may obtain the final result information RI by comparing the result values with the table 400 stored in the second memory 155. For example, upon obtaining a first result value 410, the second processor 150 may determine that the performance of the first speaker 130 is abnormal. Upon obtaining a second result value 420, the second processor 150 may determine that the performance of the second speaker 160 and the second microphone 170 is abnormal. By the same method as described above, the first processor 120 may also obtain the final result information RI.

According to an embodiment, the second processor 150 may output a voice corresponding to the final result information RI via the second speaker 160. For example, upon identifying that the user wears the second electronic device 102 using a pressure sensor (not shown), the second processor 150 may output the voice corresponding to the final result information RI via the second speaker 160. For example, upon obtaining the first result value 410, the second processor 150 may output the voice, saying "The first speaker is abnormal," via the second speaker 160.

According to an embodiment, the second speaker 160 may include a plurality of vibration components. For example, each of the plurality of vibration components may output a different frequency band of sound. The second processor 150 may output the second sound S2 via at least some of the plurality of vibration components.

Although FIG. 2 illustrates that the second electronic device 102 includes the second microphone 170 alone, this is merely for ease of description, and the technical spirit of the disclosure may not be limited thereto. For example, the second electronic device 102 may include a plurality of microphones. In this case, the second processor 150 may obtain the second result information indicating the performance of the first speaker 130, the second speaker 160, and the plurality of microphones by the above-described method.

According to an embodiment, the third electronic device 104 may include a third processor 180, a third memory 185, a sensor 190, and a third communication module 195.

According to an embodiment, the third processor 180 may control the overall operation of the third electronic device 104. The third processor 180 may transmit/receive data to/from the first electronic device 101, the second electronic device 102, and the fourth electronic device 108 via the third communication module 195. For example, the third communication module 195 may support a contact-type communication interface or wireless communication technology (e.g., Bluetooth communication technology).

According to an embodiment, the third processor 180 may transmit a notification signal NI indicating whether the cover (e.g., the lid of the third electronic device 104) is open or closed, with the first electronic device 101 and the second electronic device 102 mounted, to the first electronic device 101 and/or the second electronic device 102 via the third communication module 195. For example, the notification signal NI may mean a signal indicating the open/closed state of the cover. For example, the third electronic device 104 may identify the closed state (or open state) of the cover by detecting a magnetic force by a magnet included in the cover, via the sensor 190 (e.g., a hall sensor).

According to an embodiment, the third processor 180 may obtain the final result information RI from the first electronic device 101 or the second electronic device 102 via the third communication module 195. The third processor 180 may obtain the first result information RI1 and the second result information RI2 from the first electronic device 101 or second electronic device 102 via the third communication module 195. The third processor 180 may obtain the final result information RI based on the first result information RI1 and the second result information RI2. The third processor 180 may provide the final result information RI to a visual and/or tactile means via an output device (not shown). The third processor 180 may store the final result information RI in the third memory 185.

Although FIG. 2 illustrates that each of the first electronic device 101 and the second electronic device 102 includes one microphone and one speaker, the technical spirit of the disclosure may not be limited thereto. In other words, although each of the first electronic device 101 and the second electronic device 102 includes a plurality of microphones and/or speakers, the first electronic device 101 and the second electronic device 102 may identify whether the performance of the microphones and/or speakers is normal by the same method as those described above.

For ease of description, it is hypothesized that the first electronic device 101 and the second electronic device 102 are a first earphone and a second earphone, respectively. It is also hypothesized that the third electronic device 104 is a cradle, and the fourth electronic device 108 is an external terminal. However, the disclosure may not be limited thereto.

Figure 5:
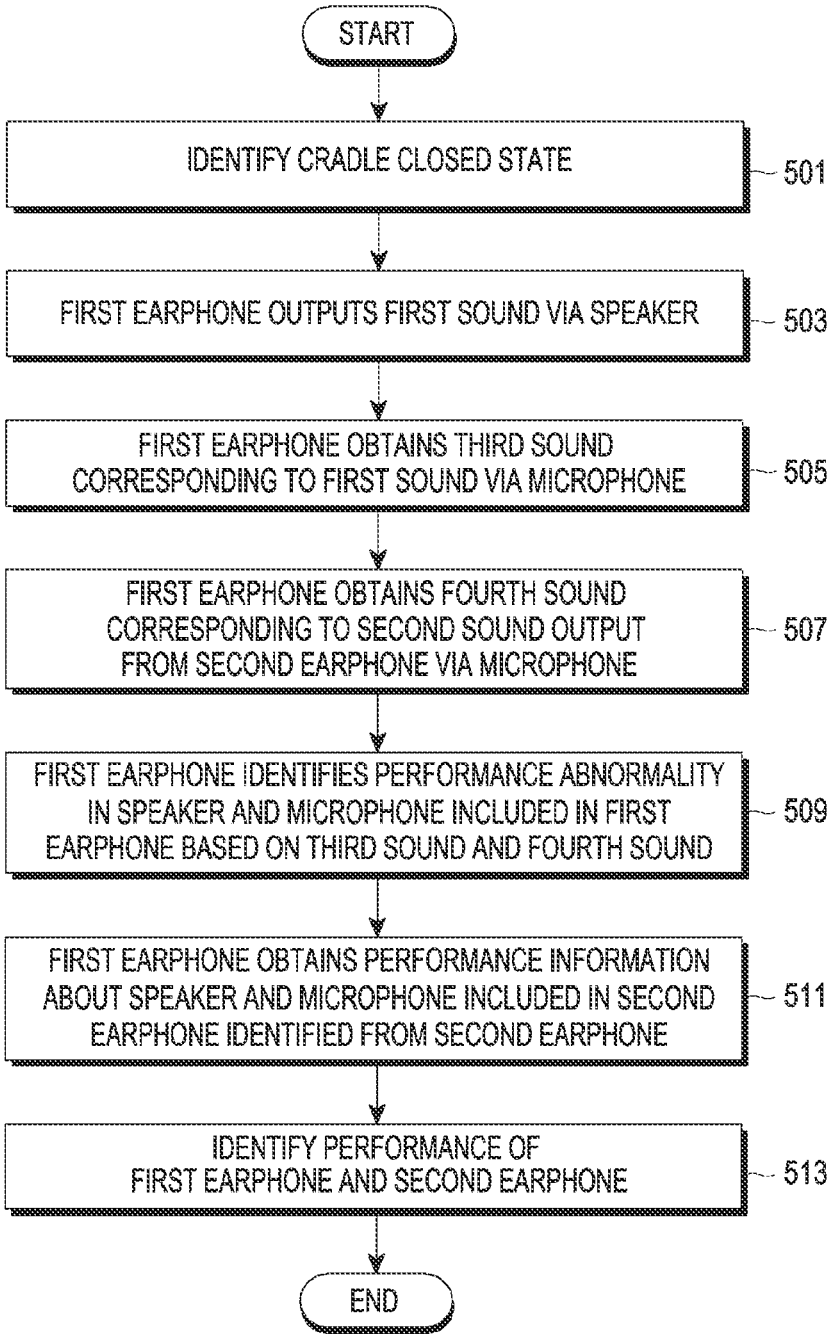
FIG. 5 is a flowchart illustrating the operation of identifying whether the performance of a speaker and a microphone is normal, by an electronic device, according to an embodiment.

FIG. 5 is a flowchart illustrating the operation of identifying whether the performance of a speaker and a microphone is normal, by an electronic device, according to an embodiment.

Referring to FIG. 5, according to an embodiment, in operation 501, the first earphone 101 may identify whether the cradle 104 is in the closed state. For example, the first earphone 101 may identify whether the cradle 104 is in the closed state based on the notification signal received from the cradle 104. The first earphone 101 may identify whether the first earphone 101 is mounted on the cradle 104. For example, when the first earphone 101 contacts the charging terminals included in the cradle 104, the first earphone 101 may be determined to be mounted on the cradle 104.

According to an embodiment, the first earphone 101 may perform the operation of identifying whether the performance of the earphone is normal, with the cradle 104 in the closed state. For example, the first earphone 101 may perform the operation of identifying whether the performance of the earphone is normal, automatically whenever the cradle 104 is closed. The first earphone 101 may perform the operation of identifying whether the performance of the earphone is normal when the cradle 104 is closed a predetermined number of times. According to an embodiment, upon identifying a trigger signal requesting to identify the performance of the earphone, the first earphone 101 may perform the operation of identifying whether the performance of the earphone is normal. For example, the trigger signal may be generated in response to a user input requesting to identify the performance of the earphone. For example, the first earphone 101 may receive a trigger signal from the external terminal 108. The first earphone 101 may receive a trigger signal from the cradle 104.

According to an embodiment, in operation 503, the first earphone 101 may output a first sound with a predetermined frequency, via the first speaker 130, with the cradle 104 in the closed state. For example, the predetermined frequency may be a frequency in several bands including the audible frequency.

According to an embodiment, in operation 505, the first earphone 101 may obtain a third sound corresponding to the first sound via the first microphone 140. For example, the third sound may be a sound resultant as the first sound is reflected in the closed space formed as the cradle 104 is closed and enters the first microphone 140.

According to an embodiment, in operation 507, the first earphone 101 may obtain a fourth sound corresponding to the second sound output from the external second earphone 102 via the first microphone 140. For example, the fourth sound may be a sound resultant as the second sound is reflected in the closed space formed as the cradle 104 is closed and enters the first microphone 140.

According to an embodiment, in operation 509, the first earphone 101 may identify whether the performance of the first speaker 130 and the first microphone 140 included in the first earphone 101 is normal, based on the third sound and the fourth sound.

According to an embodiment, in operation 511, the first earphone 101 may obtain the performance information about the second speaker 160 and the second microphone 170 included in the external second earphone identified by the external second earphone 102.

According to an embodiment, in operation 513, the first earphone 101 may identify the performance of the first earphone 101 and the second earphone 102. For example, the first earphone 101 may identify whether the performance of the first speaker 130, the first microphone 140, the second speaker 160, and the fourth microphone 170 is normal.

Figure 6:
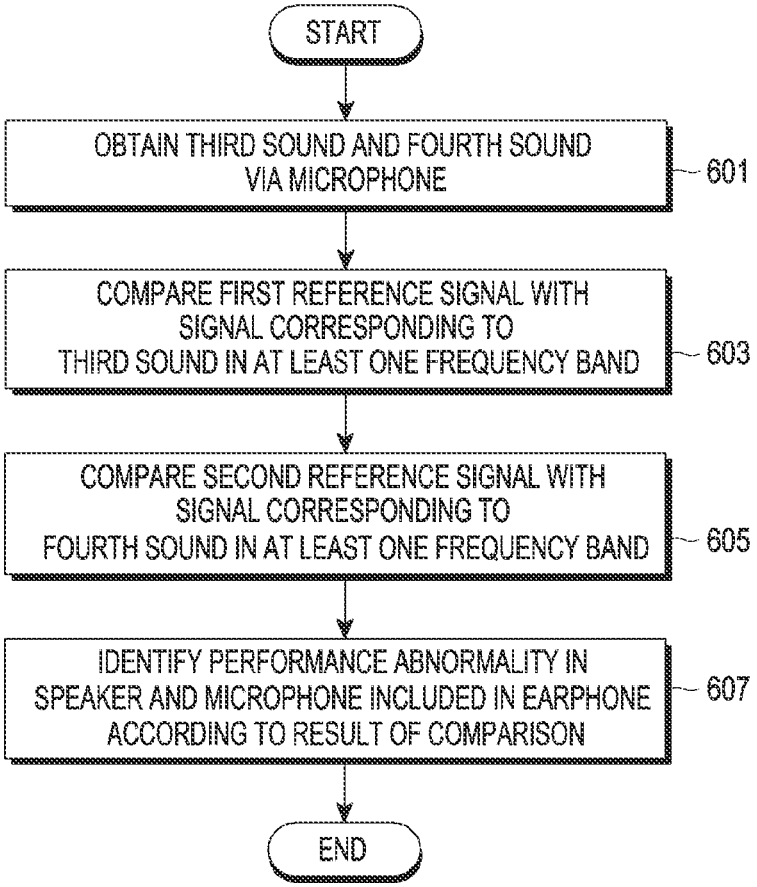
FIG. 6 is a flowchart illustrating a method for comparing a reference signal with a signal corresponding to a sound obtained by an electronic device according to an embodiment.

FIG. 6 is a flowchart illustrating a method for comparing a reference signal with a signal corresponding to a sound obtained by an electronic device according to an embodiment.

Referring to FIG. 6, according to an embodiment, in operation 601, the first earphone 101 may obtain the third sound and the fourth sound via the first microphone 140. For example, when the cradle 104 is identified to be in the closed state, the first earphone 101 may sequentially obtain the third sound and the fourth sound.

According to an embodiment, in operation 603, the first earphone 101 may compare a first reference signal with a first signal corresponding to the third sound in at least one frequency band. According to an embodiment, in operation 605, the first earphone 101 may compare a second reference signal with a second signal corresponding to the fourth sound in at least one frequency band. For example, each frequency band may be determined to determine whether there is a specific foreign matter. According to an embodiment, operation 603 may be performed before the third sound and the fourth sound are obtained. After the fourth sound is obtained, operation 605 may be performed. According to an embodiment, after the third sound and fourth sound are obtained, operations 603 and 605 may sequentially be performed.

According to an embodiment, in operation 607, the first earphone 101 may identify whether the performance of the first speaker 130 and the first microphone 140 included in the first earphone 101 is normal according to the result of comparison. However, for the first earphone 101 to accurately determine whether the performance is normal, the first earphone 101 may need information about the performance of the second speaker 160 and the second microphone 170 obtained from the external second earphone 102. To that end, the first earphone may obtain information about the performance of the second speaker 160 and the second microphone 170 from the second earphone 102. The first earphone may identify whether the performance of the first speaker 130, the first microphone 140, the second speaker 160, and the second microphone 170 is normal, further considering the information about the second speaker 160 and the second microphone 170.

Figure 7:
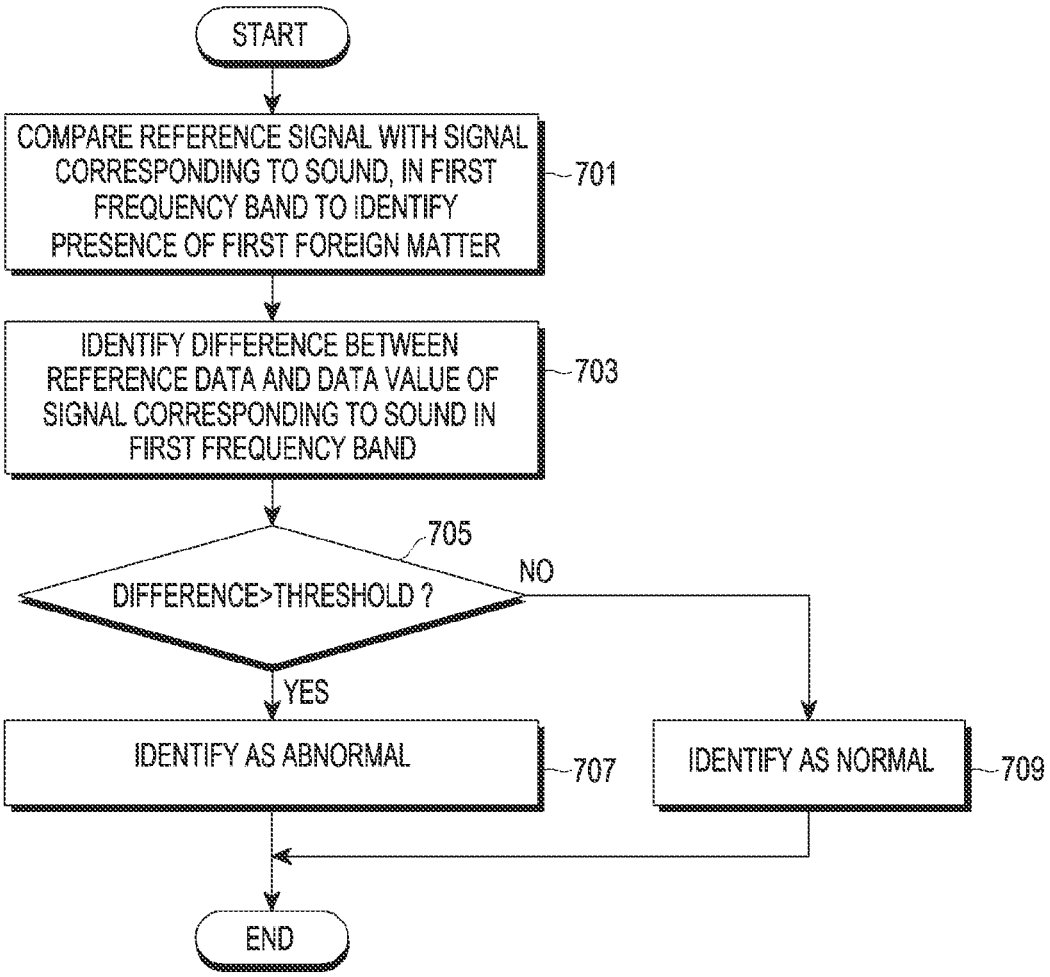
FIG. 7 is a flowchart illustrating the operation of identifying whether the performance of a speaker and a microphone is normal, by an electronic device, according to an embodiment.

FIG. 7 is a flowchart illustrating the operation of identifying whether the performance of a speaker and a microphone is normal, by an electronic device, according to an embodiment.

Referring to FIG. 7, according to an embodiment, in operation 701, the first earphone 101 may compare a reference signal (e.g., the first reference signal or the second reference signal) with a signal (e.g., the first signal or second signal) corresponding to a sound (e.g., the third sound or fourth sound) in a first frequency band for identifying the presence of a first foreign matter. For example, the reference signal may be a signal obtained when the user first uses the first earphone 101. The reference signal may be a signal previously stored in the step of manufacturing the first earphone 101.

For ease of description, the description focuses primarily on the operation in which the first earphone 101 compares the first reference signal with the first signal corresponding to the third sound. However, the first earphone 101 may perform the operation of comparing the second reference signal with the second signal corresponding to the fourth sound by the same method as described above.

According to an embodiment, in operation 703, the first earphone 101 may identify a difference between a reference data value with the data value of the first signal corresponding to the sound in the first frequency band.

According to an embodiment, the first earphone 101 may compare the difference between the data value of the first signal and the reference data value and a predetermined threshold. In operation 705, the first earphone 101 may identify whether the difference between the data value of the first signal and the reference data value exceeds the threshold.

According to an embodiment, when the difference between the data value of the first signal and the reference data value exceeds the threshold (yes in operation 705), the first earphone 101 may identify that the performance of at least one of the first speaker 130, the first microphone 140, and the second speaker 160 is abnormal in operation 707.

According to an embodiment, when the difference between the data value of the first signal and the reference data value does not exceed the threshold (no in operation 705), the first earphone 101 may identify that the performance of at least one of the first speaker 130, the first microphone 140, and the second speaker 160 is normal in operation 709.

According to an embodiment, the first earphone 101 may compare the first reference signal with the first signal in the second frequency band corresponding to a second foreign matter so as to identify whether there is the second foreign matter different from the first foreign matter. The first earphone 101 may identify whether the performance of at least one of the first speaker 130, the first microphone 140, and the second speaker 160 is normal according to the result of comparison.

The second earphone 102 may also compare a reference signal with a signal corresponding to sound by the above-described method.

Figure 8:
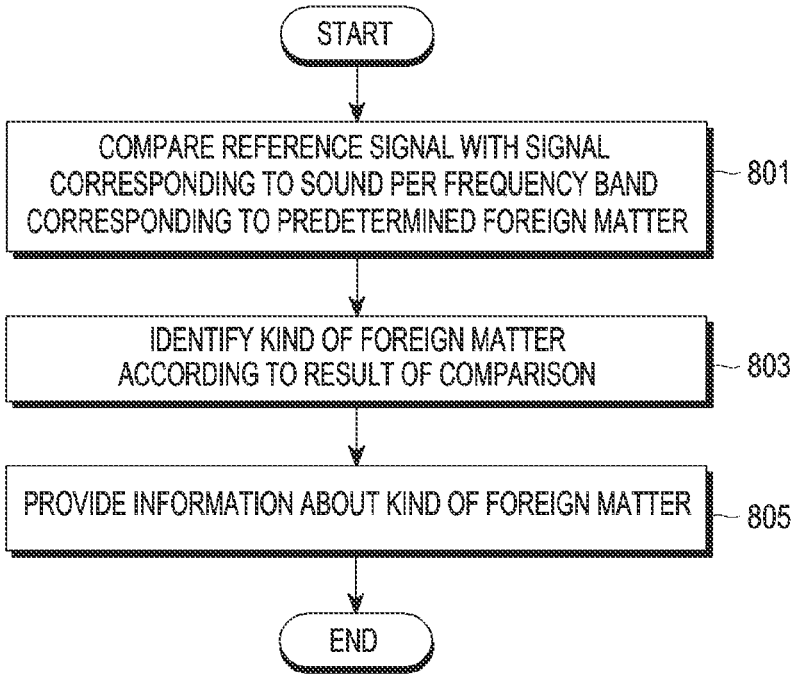
FIG. 8 is a flowchart illustrating the operation of providing information about a foreign matter by an electronic device according to an embodiment.

FIG. 8 is a flowchart illustrating the operation of providing information about a foreign matter by an electronic device according to an embodiment. FIGS. 9A and 9B are views illustrating the operation of providing information about a foreign matter by an electronic device according to an embodiment.

Referring to FIG. 8, according to an embodiment, in operation 801, the first earphone 101 may compare a reference signal (e.g., the first reference signal or the second reference signal) with a signal (e.g., the first signal or second signal) corresponding to a sound (e.g., the third sound or fourth sound) per frequency band corresponding to a predetermined foreign matter.

For ease of description, the description focuses primarily on the operation in which the first earphone 101 compares the first reference signal with the first signal corresponding to the third sound. However, the first earphone 101 may perform the operation of comparing the second reference signal with the second signal corresponding to the fourth sound by the same method as described above.

According to an embodiment, in operation 803, the first earphone 101 may identify the kind of the foreign matter according to the result of comparison.

Referring to FIG. 9A, the first earphone 101 may determine a frequency band for identifying whether there is a specific foreign matter. For example, the frequency band may be determined depending on the kind of the foreign matter. Reference data may be designated to determine whether there is a foreign matter per frequency band. A threshold may be designated to determine whether there is a foreign matter per frequency band. For example, to determine whether there is the foreign matter "water," the first earphone 101 may compare the first signal with the first reference signal in a first frequency band (e.g., 15,000 Hz). In this case, the reference data value of the first reference signal may be 60 dB. In other words, the first earphone 101 may identify whether the difference between the reference data value and the value of the first signal at 15,000 Hz is 2 dB and, according to the result of identification, determine whether the performance of the first earphone 101 or second earphone 102 is normal. For example, to determine whether there is the foreign matter "stone," the first earphone 101 may compare the first signal with the first reference signal in a second frequency band (e.g., 12,000 Hz). In this case, the reference data value of the first reference signal may be 50 dB. In other words, the first earphone 101 may identify whether the difference between the reference data value and the value of the first signal at 12,000 Hz is 5 dB and, according to the result of identification, determine whether the performance of the first earphone 101 or second earphone 102 is normal.

Referring to FIG. 9B, the first earphone 101 may identify foreign bodies that may be mixed together. For example, the foreign bodies "water" and "starch" may be mixed. However, upon comparing the reference signal with the first signal in the frequency band (e.g., 15,000 Hz) corresponding to "water" and the frequency band 9 e.g., 375 Hz) corresponding to "starch," the first earphone 101 may identify the foreign matter mix of "water" and "starch" as "water."

According to an embodiment, when the foreign matter is identified as a mixable material (e.g., "water" or "starch"), the first earphone 101 may identify whether the kind of the foreign matter is "water" or "starch" or a mix of "water" or another foreign matter (e.g., starch).

According to an embodiment, when the foreign matter is identified as "water" or "starch," the first earphone 101 may compare the reference signal with the first signal in three additional frequency bands. For example, when the threshold is exceeded only in the frequency band of "375 Hz," the first earphone 101 may determine that the foreign matter is "starch." When the threshold is exceeded in the frequency band of "3,234 Hz" and the frequency band of "9,890 Hz" as well as the frequency band of "375 Hz," the first earphone 101 may determine that the foreign matter is "water." In other cases, the first earphone 101 may determine that the foreign matter is a mixture of "water" and "starch."

According to an embodiment, in operation 805, the first earphone 101 may provide information about the kind of the foreign matter. For example, the first earphone 101 may provide the information about the kind of the foreign matter to the cradle 104 and/or the external terminal 108. When the first earphone 101 is identified to be worn by the user, the first earphone 101 may output the information about the kind of the foreign matter as a sound via the first speaker 130.

The second earphone 102 may also provide information about the kind of the foreign matter by the above-described method.

Figure 10:
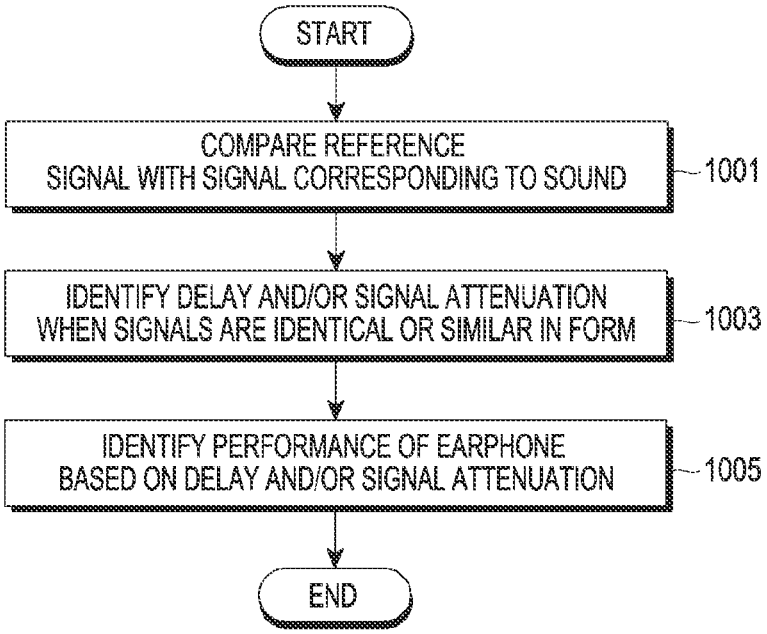
FIG. 10 is a flowchart illustrating the operation of identifying whether the performance of a speaker and a microphone is normal, based on signal attenuation and delay by an electronic device, according to an embodiment.
Figure 11:
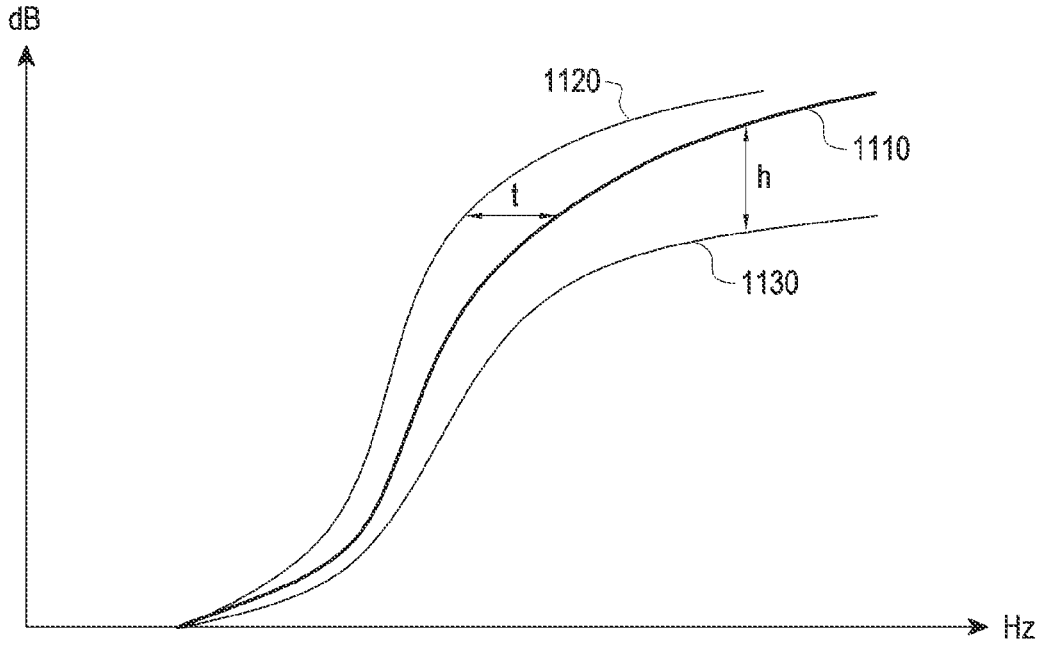
FIG. 11 is a view illustrating the operation of identifying whether the performance of a speaker and a microphone is normal, based on signal attenuation and delay by an electronic device, according to an embodiment.

FIG. 10 is a flowchart illustrating the operation of identifying whether the performance of a speaker and a microphone is normal, based on signal attenuation and delay by an electronic device, according to an embodiment. FIG. 11 is a view illustrating the operation of identifying whether the performance of a speaker and a microphone is normal, based on signal attenuation and delay by an electronic device, according to an embodiment.

Referring to FIG. 10, according to an embodiment, in operation 1001, the first earphone 101 may compare a reference signal (e.g., the first reference signal or the second reference signal) with a signal (e.g., the first signal or second signal) corresponding to a sound (e.g., the third sound or fourth sound).

According to an embodiment, in operation 1003, when both signals are identical or similar in form, the first earphone 101 may identify whether the signal corresponding to sound is attenuated and/or delayed based on a reference signal.

Referring to FIG. 11, according to an embodiment, the first earphone 101 may compare a reference signal 1110 with a signal 1120 or 1130 corresponding to sound. For example, the first earphone 101 may compare the reference signal 1110 with the signal 1120 and determine that the signal 1120 has been delayed by time "t." The first earphone 101 may compare the reference signal 1110 with the signal 1130 and determine that the signal 1130 has been attenuated by strength "h."

According to an embodiment, in operation 1005, the first earphone 101 may identify whether the performance of the earphone is normal based on the attenuation and/or delay of the signal. For example, upon identifying the signal attenuation and/or delay, the first earphone 101 may determine that the performance of earphone is abnormal. When the degree of the signal attenuation and/or delay exceeds a predetermined threshold, the first earphone 101 may determine that the performance of the earphone (e.g., the first earphone 101 and/or the second earphone 102) is abnormal. When the degree of the signal attenuation and/or delay is not more than the predetermined threshold, the first earphone 101 may determine that the performance of the earphone (e.g., the first earphone 101 and/or the second earphone 102) is normal.

Figure 12A:
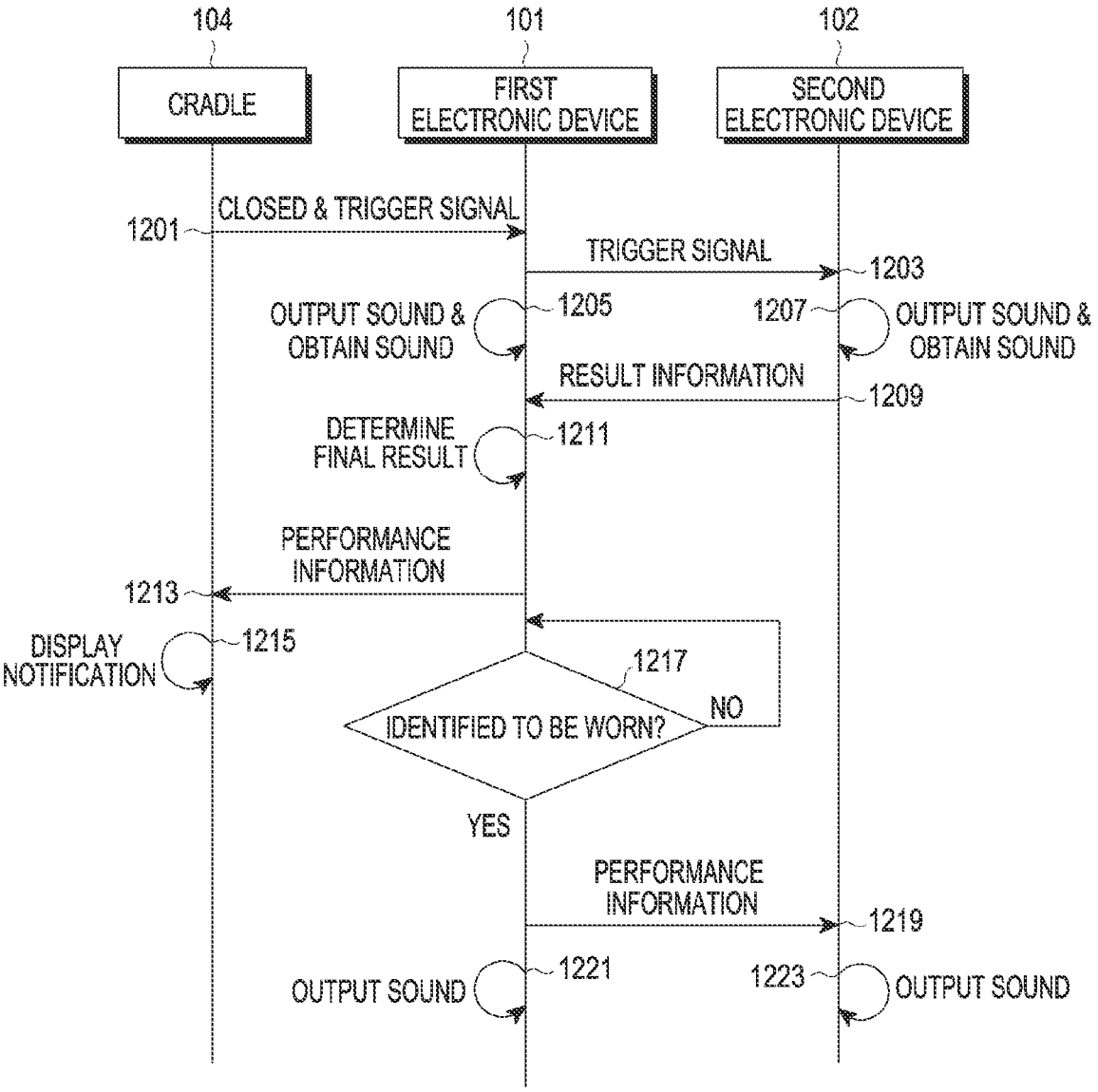
FIGS. 12A and 12B are views illustrating the operation of providing information about whether the performance of a speaker and a microphone is normal, by an electronic device, according to an embodiment.
Figure 12B:
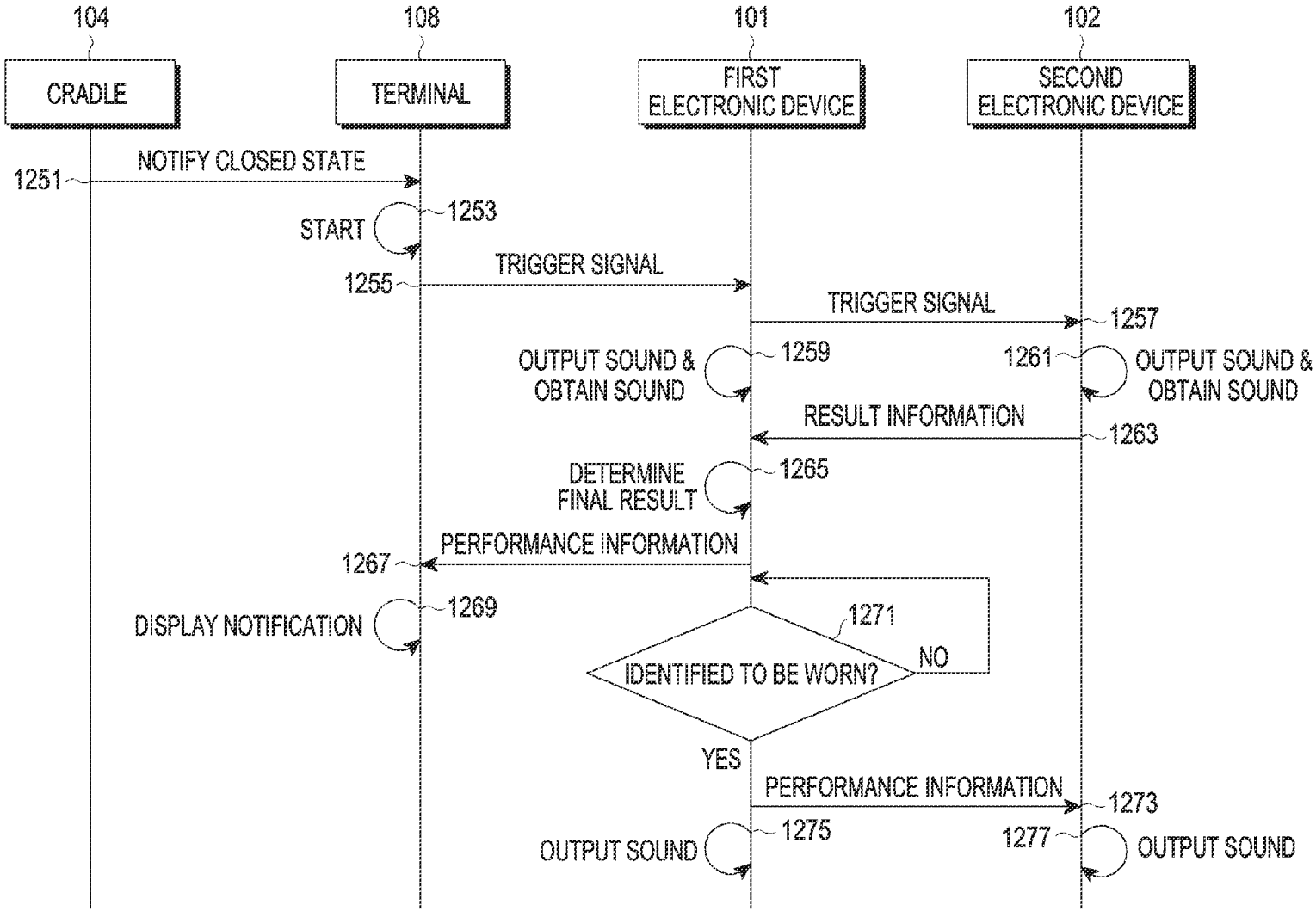

FIGS. 12A and 12B are views illustrating the operation of providing information about whether the performance of a speaker and a microphone is normal, by an electronic device, according to an embodiment.

Referring to FIG. 12A, according to an embodiment, in operation 1201, when the cradle 104 becomes the closed state, the first electronic device 101 (or first earphone) may receive a notification signal indicating the closed state from the cradle 104. Upon identifying a user input to request to identify the earphone performance by the cradle 104, the first electronic device 101 may receive a trigger signal from the cradle 104. For example, the trigger signal may be a signal for starting the operation of identifying, by the first electronic device 101, whether the earphone performance is normal.

According to an embodiment, in operation 1203, the first electronic device 101 may transmit (or forward) the trigger signal to the second electronic device 102 (or the second earphone).

According to an embodiment, in operation 1205, the first electronic device 101 may output the first sound. In operation 1207, the second electronic device 102 may output the second sound based on the trigger signal. The first electronic device 101 may obtain the third sound, which is a reflection of the first sound in the closed space of the cradle 104, and the fourth sound, which is a reflection of the second sound in the closed space of the cradle 104. The second electronic device 102 may also obtain the third sound and the fourth sound. For example, operations 1205 and 1207 may be performed for the first electronic device 101 and the second electronic device 102 to sequentially output the first sound and the second sound and to obtain the third sound and the fourth sound.

According to an embodiment, in operation 1209, the second electronic device 102 may obtain information about the performance of the second electronic device 102 (e.g., the performance of the first speaker 130, the second speaker 160, and the second microphone 170) by analyzing the third sound and the fourth sound and transmit the performance information about the second electronic device 102 to the first electronic device 101.

According to an embodiment, the first electronic device 101 may obtain information about the performance of the first electronic device 101 (e.g., the performance of the first speaker 130, the second speaker 160, and the second microphone 170) by analyzing the third sound and the fourth sound. In operation 1211, the first electronic device 101 may determine final result information based on the information about the performance of the first electronic device 101 and information about the performance of the second electronic device 102. For example, the final result information may include information about whether the performance of the first speaker 130, the first microphone 140, the second speaker 160, and the second microphone 170 is normal.

According to an embodiment, in operation 1213, the first electronic device 101 may transmit final result information about the performance of the first electronic device 101 and the second electronic device 102 to the cradle 104.

According to an embodiment, in operation 1215, the cradle 104 may display a notification including the final result information about the performance. For example, when the cradle 104 includes a display, the cradle 104 may display the final result information via the display. When the cradle 104 includes a light emitting element, the cradle 104 may output a specific color of light (e.g., red for abnormal performance and green for normal performance) via the light emitting element.

According to an embodiment, in operation 1217, the first electronic device 101 may identify whether the first electronic device 101 is worn by the user.

According to an embodiment, when the first electronic device 101 is identified to be worn by the user (yes in 1217), the first electronic device 101 may transmit the final result information about performance to the second electronic device 102 in operation 1219.

According to an embodiment, in operation 1221, the first electronic device 101 may output a voice for the final result information. In operation 1223, the second electronic device 102 may also a voice for the final result information. For example, the first electronic device 101 and the second electronic device 102 may simultaneously output a voice for final result information.

Referring to FIG. 12B, according to an embodiment, in operation 1251, the cradle 104 may transmit a closed state notification signal to the external terminal 108 when the cradle 104 becomes the closed state.

According to an embodiment, in operation 1253, the terminal 108 may generate a trigger signal to start to identify the performance of earphone upon identifying a user input to request to identify the earphone performance. For example, when an application for managing the wireless earphones is executed, the terminal 108 may display an execution screen including an object for identifying the earphone performance. Upon identifying a user input for the object, the terminal 108 may generate a trigger signal. For example, the trigger signal may be a signal for starting the operation of identifying, by the first electronic device 101, whether the earphone performance is normal.

According to an embodiment, in operation 1255, the terminal 108 may transmit the trigger signal to the first electronic device 101 (or first earphone). In operation 1257, the first electronic device 101 may transmit (or forward) the trigger signal to the second electronic device 102 (or the second earphone).

According to an embodiment, in operation 1259, the first electronic device 101 may output the first sound. In operation 1261, the second electronic device 102 may output the second sound based on the trigger signal. The first electronic device 101 may obtain the third sound, which is a reflection of the first sound in the closed space of the cradle 104, and the fourth sound, which is a reflection of the second sound in the closed space of the cradle 104. The second electronic device 102 may also obtain the third sound and the fourth sound. For example, operations 1259 and 1261 may be performed for the first electronic device 101 and the second electronic device 102 to sequentially output the first sound and the second sound and to obtain the third sound and the fourth sound.

According to an embodiment, in operation 1263, the second electronic device 102 may obtain information about the performance of the second electronic device 102 (e.g., the performance of the first speaker 130, the second speaker 160, and the second microphone 170) by analyzing the third sound and the fourth sound and transmit the performance information about the second electronic device 102 to the first electronic device 101.

According to an embodiment, the first electronic device 101 may obtain information about the performance of the first electronic device 101 (e.g., the performance of the first speaker 130, the second speaker 160, and the second microphone 170) by analyzing the third sound and the fourth sound. In operation 1265, the first electronic device 101 may determine final result information based on the information about the performance of the first electronic device 101 and information about the performance of the second electronic device 102. For example, the final result information may include information about whether the performance of the first speaker 130, the first microphone 140, the second speaker 160, and the second microphone 170 is normal.

According to an embodiment, in operation 1267, the first electronic device 101 may transmit final result information about the performance of the first electronic device 101 and the second electronic device 102 to the terminal 108.

According to an embodiment, in operation 1269, the terminal 108 may display a notification including the final result information about the performance. For example, the terminal 108 may display the final result information via the display. The terminal 108 may display the final result information on the execution screen of the application for managing the wireless earphones.

According to an embodiment, in operation 1271, the first electronic device 101 may identify whether the first electronic device 101 is worn by the user.

According to an embodiment, when the first electronic device 101 is identified to be worn by the user (yes in 1271), the first electronic device 101 may transmit the final result information about performance to the second electronic device 102 in operation 1273.

According to an embodiment, in operation 1275, the first electronic device 101 may output a voice for the final result information. In operation 1277, the second electronic device 102 may also a voice for the final result information. For example, the first electronic device 101 and the second electronic device 102 may simultaneously output a voice for final result information.

FIGS. 13A to 13E are views illustrating the operation of providing information about whether the performance of a speaker and a microphone is normal, by an electronic device, according to an embodiment.

Figure 13A:
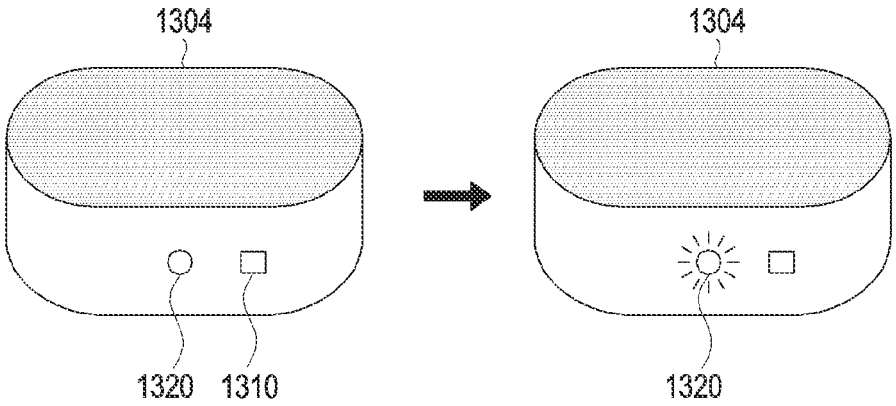
FIGS. 13A to 13E are views illustrating the operation of providing information about whether the performance of a speaker and a microphone is normal, by an electronic device, according to an embodiment.

Referring to FIG. 13A, a cradle 1304 (e.g., the third electronic device 103 of FIG. 1) may include a first button 1310 and a light emitting element 1320.

According to an embodiment, the cradle 1304 may identify a user input for the first button 1310. Upon identifying the user input for the first button 1310, the cradle 1304 may transmit a trigger signal to a first earphone (e.g., the first electronic device 101 of FIG. 1). For example, the trigger signal may be a signal for starting the operation of identifying whether the performance of the wireless earphones (e.g., the first earphone 101 and the second earphone 102) is normal.

According to an embodiment, the cradle 1304 may receive the final result information about the performance of the wireless earphones from the first earphone 101 and display the final result information via the light emitting element 1320. For example, the cradle 1304 may output a specific color of light (e.g., red for abnormal performance and green for normal performance) via the light emitting element 1320.

Figure 13B:
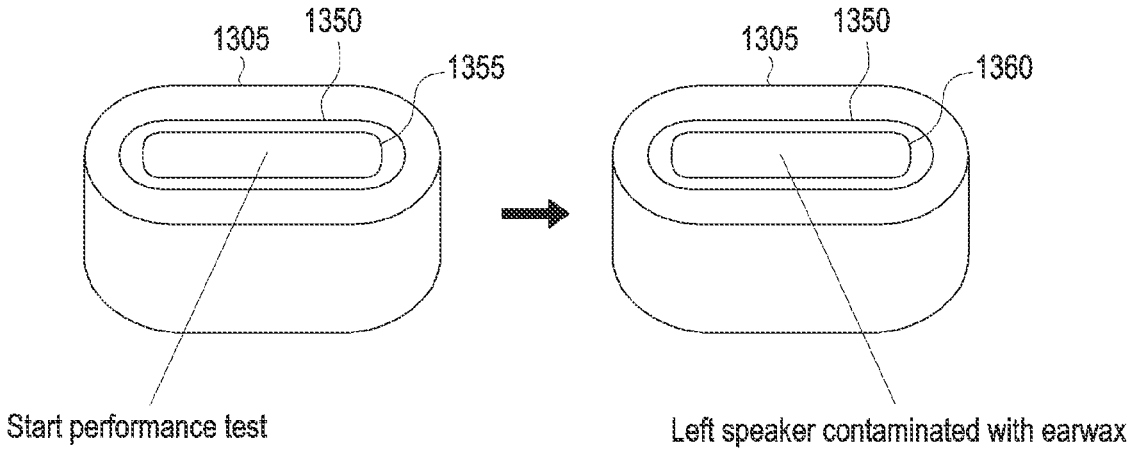

Referring to FIG. 13B, a cradle 1305 (e.g., the third electronic device 104 of FIG. 1) may include a touchscreen 1350.

According to an embodiment, the cradle 1305 may display an object 1355 for identifying the performance of the wireless earphones via the touchscreen 1350. Upon identifying a user input for the object 1355, the cradle 1305 may transmit a trigger signal to a first earphone (e.g., the first electronic device 101 of FIG. 1). For example, the trigger signal may be a signal for starting the operation of identifying whether the performance of the wireless earphones (e.g., the first earphone 101 and the second earphone 102) is normal.

According to an embodiment, the cradle 1305 may receive the final result information about the performance of the wireless earphones from the first earphone 101 and display information 1360 about the performance of the wireless earphones on the touchscreen 1350 based on the final result information. For example, the cradle 1305 may provide information about which one of the first earphone 101 and the second earphone 102 has an abnormal performance (e.g., an abnormality in the speaker of the left earphone) and information about the cause of the performance abnormality (e.g., earwax contamination).

Figure 13C:
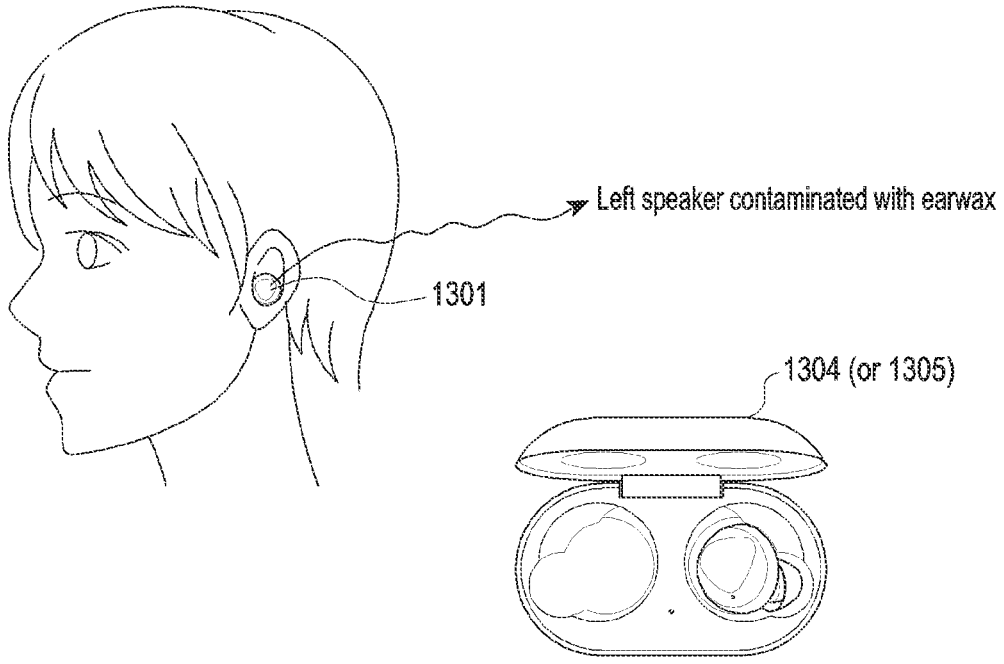

Referring to FIG. 13C, a first earphone 1301 (e.g., the first electronic device 101 of FIG. 1) may identify whether the first earphone 1301 is worn by the user.

According to an embodiment, the first earphone 1301 may output the final result information about the performance of the wireless earphones as a voice. For example, the first earphone 1301 may provide information about which one of the first earphone 1301 and the second earphone 102 has an abnormal performance (e.g., an abnormality in the speaker of the left earphone) and information about the cause of the performance abnormality (e.g., earwax contamination).

Figure 13D:
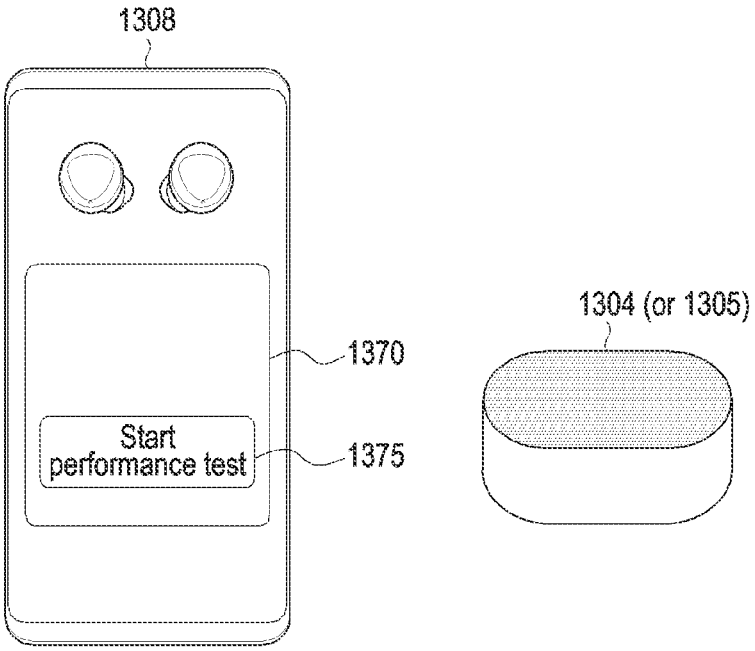

Referring to FIG. 13D, a terminal 1308 (e.g., the fourth electronic device 108 of FIG. 1) may display an execution screen of a wireless earphone managing application. When the application is executed, the terminal 1308 may display a user interface 1370 for identifying the earphone performance on the display. The terminal 1308 may display an object 1375 for starting a performance test on the user interface 1370. The terminal 1308 may identify the closed state of the cradle 1304 or 1305 based on a closed state notification signal received from the cradle 1304 or 1305. When the cradle 1304 or 1305 is identified to be in the closed state, the terminal 1308 may transmit a command to start the performance test to the first earphone 1301 in response to a user input to the object 1375.

Figure 13E:
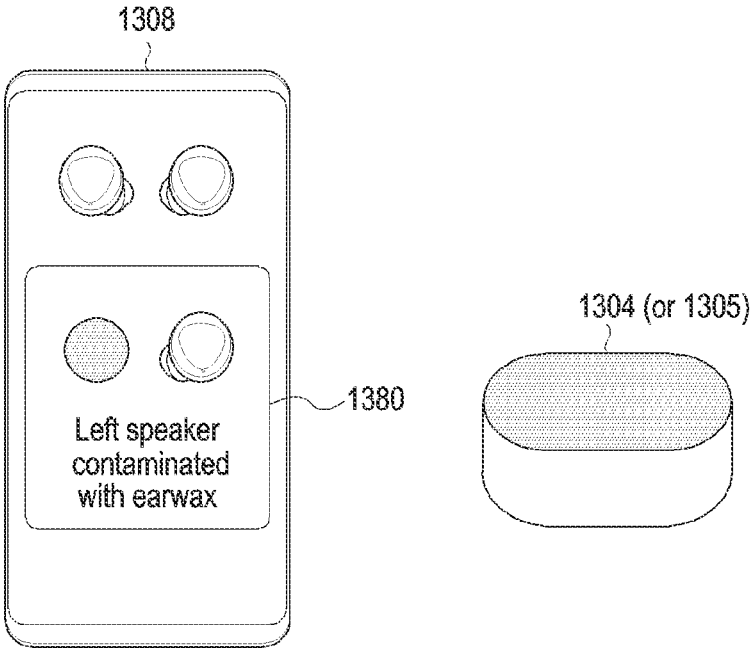

Referring to FIG. 13E, the terminal 1308 may receive the final result information about the performance of the speaker and microphone of the wireless earphones (e.g., the first earphone and the second earphone) from the first earphone 1301.

According to an embodiment, the terminal 1308 may display the final result information 1380 about the performance of the wireless earphones on the display. For example, the terminal 1308 may provide information about which one of the first earphone 1301 and the second earphone 102 has an abnormal performance (e.g., an abnormality in the speaker of the left earphone) and information about the cause of the performance abnormality (e.g., earwax contamination).

According to an embodiment, the first electronic device 101 may be implemented to be identical or similar to the electronic device 1401 of FIG. 1 described below. The second electronic device 102, the third electronic device 104, and the fourth electronic device 108 may be implemented to be identical or similar to the electronic devices 1402, 1404, and 1408 of FIG. 14 described below.

Figure 14:
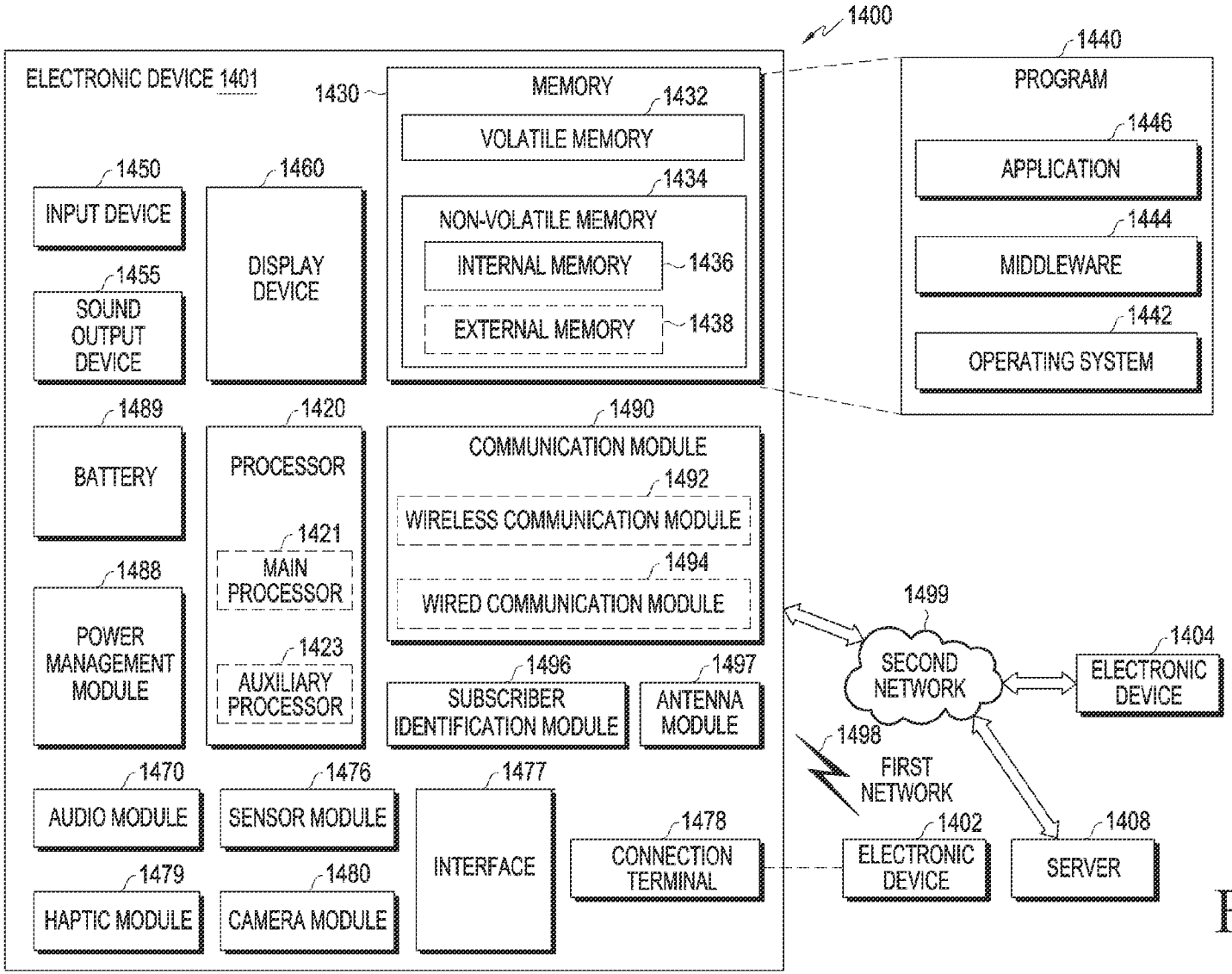
FIG. 14 is a block diagram illustrating an electronic device in a network environment according to an embodiment.

FIG. 14 is a block diagram illustrating an electronic device 1401 in a network environment 1400 according to various embodiments. Referring to FIG. 14, the electronic device 1401 in the network environment 1400 may communicate with an electronic device 1402 via a first network 1498 (e.g., a short-range wireless communication network), or an electronic device 1404 or a server 1408 via a second network 1499 (e.g., a long-range wireless communication network). According to an embodiment, the electronic device 1401 may communicate with the electronic device 1404 via the server 1408. According to an embodiment, the electronic device 1401 may include a processor 1420, memory 1430, an input module 1450, a sound output module 1455, a display module 1460, an audio module 1470, a sensor module 1476, an interface 1477, a connecting terminal 1478, a haptic module 1479, a camera module 1480, a power management module 1488, a battery 1489, a communication module 1490, a subscriber identification module (SIM) 1496, or an antenna module 1497. In some embodiments, at least one (e.g., the connecting terminal 1478) of the components may be omitted from the electronic device 1401, or one or more other components may be added in the electronic device 101. According to an embodiment, some (e.g., the sensor module 1476, the camera module 1480, or the antenna module 1497) of the components may be integrated into a single component (e.g., the display module 1460).

The processor 1420 may execute, for example, software (e.g., a program 1440) to control at least one other component (e.g., a hardware or software component) of the electronic device 1401 coupled with the processor 1420, and may perform various data processing or computation. According to one embodiment, as at least part of the data processing or computation, the processor 1420 may store a command or data received from another component (e.g., the sensor module 1476 or the communication module 1490) in volatile memory 1432, process the command or the data stored in the volatile memory 1432, and store resulting data in non-volatile memory 1434. According to an embodiment, the processor 1420 may include a main processor 1421 (e.g., a central processing unit (CPU) or an application processor (AP)), or an auxiliary processor 1423 (e.g., a graphics processing unit (GPU), a neural processing unit (NPU), an image signal processor (ISP), a sensor hub processor, or a communication processor (CP)) that is operable independently from, or in conjunction with, the main processor 121. For example, when the electronic device 1401 includes the main processor 1421 and the auxiliary processor 1423, the auxiliary processor 1423 may be configured to use lower power than the main processor 1421 or to be specified for a designated function. The auxiliary processor 1423 may be implemented as separate from, or as part of the main processor 1421.

The auxiliary processor 1423 may control at least some of functions or states related to at least one component (e.g., the display module 1460, the sensor module 1476, or the communication module 1490) among the components of the electronic device 1401, instead of the main processor 1421 while the main processor 1421 is in an inactive (e.g., sleep) state, or together with the main processor 1421 while the main processor 1421 is in an active state (e.g., executing an application). According to an embodiment, the auxiliary processor 1423 (e.g., an image signal processor or a communication processor) may be implemented as part of another component (e.g., the camera module 1480 or the communication module 1490) functionally related to the auxiliary processor 123. According to an embodiment, the auxiliary processor 1423 (e.g., the neural processing unit) may include a hardware structure specified for artificial intelligence model processing. The artificial intelligence model may be generated via machine learning. Such learning may be performed, e.g., by the electronic device 1401 where the artificial intelligence is performed or via a separate server (e.g., the server 1408). Learning algorithms may include, but are not limited to, e.g., supervised learning, unsupervised learning, semi-supervised learning, or reinforcement learning. The artificial intelligence model may include a plurality of artificial neural network layers. The artificial neural network may be a deep neural network (DNN), a convolutional neural network (CNN), a recurrent neural network (RNN), a restricted Boltzmann machine (RBM), a deep belief network (DBN), a bidirectional recurrent deep neural network (BRDNN), deep Q-network or a combination of two or more thereof but is not limited thereto. The artificial intelligence model may, additionally or alternatively, include a software structure other than the hardware structure.

The memory 1430 may store various data used by at least one component (e.g., the processor 1420 or the sensor module 1476) of the electronic device 1401. The various data may include, for example, software (e.g., the program 1440) and input data or output data for a command related thereto. The memory 1430 may include the volatile memory 1432 or the non-volatile memory 1434.

The program 1440 may be stored in the memory 1430 as software, and may include, for example, an operating system (OS) 1442, middleware 1444, or an application 1446.

The input module 1450 may receive a command or data to be used by other component (e.g., the processor 1420) of the electronic device 1401, from the outside (e.g., a user) of the electronic device 1401. The input module 1450 may include, for example, a microphone, a mouse, a keyboard, keys (e.g., buttons), or a digital pen (e.g., a stylus pen).

The sound output module 1455 may output sound signals to the outside of the electronic device 1401. The sound output module 1455 may include, for example, a speaker or a receiver. The speaker may be used for general purposes, such as playing multimedia or playing record. The receiver may be used for receiving incoming calls. According to an embodiment, the receiver may be implemented as separate from, or as part of the speaker.

The display module 1460 may visually provide information to the outside (e.g., a user) of the electronic device 1401. The display 1460 may include, for example, a display, a hologram device, or a projector and control circuitry to control a corresponding one of the display, hologram device, and projector. According to an embodiment, the display 1460 may include a touch sensor configured to detect a touch, or a pressure sensor configured to measure the intensity of a force generated by the touch.

The audio module 1470 may convert a sound into an electrical signal and vice versa. According to an embodiment, the audio module 1470 may obtain the sound via the input module 1450, or output the sound via the sound output module 1455 or a headphone of an external electronic device (e.g., an electronic device 1402) directly (e.g., wiredly) or wirelessly coupled with the electronic device 1401.

The sensor module 1476 may detect an operational state (e.g., power or temperature) of the electronic device 1401 or an environmental state (e.g., a state of a user) external to the electronic device 101, and then generate an electrical signal or data value corresponding to the detected state. According to an embodiment, the sensor module 1476 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 1477 may support one or more specified protocols to be used for the electronic device 1401 to be coupled with the external electronic device (e.g., the electronic device 1402) directly (e.g., wiredly) or wirelessly. According to an embodiment, the interface 1477 may include, for example, a high definition multimedia interface (HDMI), a universal serial bus (USB) interface, a secure digital (SD) card interface, or an audio interface.

A connecting terminal 1478 may include a connector via which the electronic device 1401 may be physically connected with the external electronic device (e.g., the electronic device 1402). According to an embodiment, the connecting terminal 1478 may include, for example, a HDMI connector, a USB connector, a SD card connector, or an audio connector (e.g., a headphone connector).

The haptic module 1479 may convert an electrical signal into a mechanical stimulus (e.g., a vibration or motion) or electrical stimulus which may be recognized by a user via his tactile sensation or kinesthetic sensation. According to an embodiment, the haptic module 1479 may include, for example, a motor, a piezoelectric element, or an electric stimulator.

The camera module 1480 may capture a still image or moving images. According to an embodiment, the camera module 1480 may include one or more lenses, image sensors, image signal processors, or flashes.

The power management module 1488 may manage power supplied to the electronic device 1401. According to one embodiment, the power management module 1488 may be implemented as at least part of, for example, a power management integrated circuit (PMIC).

The battery 1489 may supply power to at least one component of the electronic device 1401. According to an embodiment, the battery 1489 may include, for example, a primary cell which is not rechargeable, a secondary cell which is rechargeable, or a fuel cell.

The communication module 1490 may support establishing a direct (e.g., wired) communication channel or a wireless communication channel between the electronic device 1401 and the external electronic device (e.g., the electronic device 1402, the electronic device 1404, or the server 1408) and performing communication via the established communication channel. The communication module 1490 may include one or more communication processors that are operable independently from the processor 1420 (e.g., the application processor (AP)) and supports a direct (e.g., wired) communication or a wireless communication. According to an embodiment, the communication module 1490 may include a wireless communication module 1492 (e.g., a cellular communication module, a short-range wireless communication module, or a global navigation satellite system (GNSS) communication module) or a wired communication module 1494 (e.g., a local area network (LAN) communication module or a power line communication (PLC) module). A corresponding one of these communication modules may communicate with the external electronic device 1404 via a first network 1498 (e.g., a short-range communication network, such as Bluetooth™, wireless-fidelity (Wi-Fi) direct, or infrared data association (IrDA)) or a second network 1499 (e.g., a long-range communication network, such as a legacy cellular network, a 5G network, a next-generation communication network, the Internet, or a computer network (e.g., local area network (LAN) or wide area network (WAN)). These various types of communication modules may be implemented as a single component (e.g., a single chip), or may be implemented as multi components (e.g., multi chips) separate from each other. The wireless communication module 1492 may identify and authenticate the electronic device 1401 in a communication network, such as the first network 1498 or the second network 1499, using subscriber information (e.g., international mobile subscriber identity (IMSI)) stored in the subscriber identification module 1496.

The wireless communication module 1492 may support a 5G network, after a 4G network, and next-generation communication technology, e.g., new radio (NR) access technology. The NR access technology may support enhanced mobile broadband (eMBB), massive machine type communications (mMTC), or ultra-reliable and low-latency communications (URLLC). The wireless communication module 1492 may support a high-frequency band (e.g., the mmWave band) to achieve, e.g., a high data transmission rate. The wireless communication module 1492 may support various technologies for securing performance on a high-frequency band, such as, e.g., beamforming, massive multiple-input and multiple-output (massive MIMO), full dimensional MIMO (FD-MIMO), array antenna, analog beam-forming, or large scale antenna. The wireless communication module 1492 may support various requirements specified in the electronic device 1401, an external electronic device (e.g., the electronic device 1404), or a network system (e.g., the second network 1499). According to an embodiment, the wireless communication module 1492 may support a peak data rate (e.g., 20 Gbps or more) for implementing eMBB, loss coverage (e.g., 164 dB or less) for implementing mMTC, or U-plane latency (e.g., 0.5 ms or less for each of downlink (DL) and uplink (UL), or a round trip of 1 ms or less) for implementing URLLC.

The antenna module 1497 may transmit or receive a signal or power to or from the outside (e.g., the external electronic device). According to an embodiment, the antenna module 1497 may include one antenna including a radiator formed of a conductor or conductive pattern formed on a substrate (e.g., a printed circuit board (PCB)). According to an embodiment, the antenna module 1497 may include a plurality of antennas (e.g., an antenna array). In this case, at least one antenna appropriate for a communication scheme used in a communication network, such as the first network 1498 or the second network 1499, may be selected from the plurality of antennas by, e.g., the communication module 1490. The signal or the power may then be transmitted or received between the communication module 1490 and the external electronic device via the selected at least one antenna. According to an embodiment, other parts (e.g., radio frequency integrated circuit (RFIC)) than the radiator may be further formed as part of the antenna module 1497.

According to various embodiments, the antenna module 1497 may form a mmWave antenna module. According to an embodiment, the mmWave antenna module may include a printed circuit board, a RFIC disposed on a first surface (e.g., the bottom surface) of the printed circuit board, or adjacent to the first surface and capable of supporting a designated high-frequency band (e.g., the mmWave band), and a plurality of antennas (e.g., array antennas) disposed on a second surface (e.g., the top or a side surface) of the printed circuit board, or adjacent to the second surface and capable of transmitting or receiving signals of the designated high-frequency band.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 1401 and the external electronic device 1404 via the server 1408 coupled with the second network 1499. The external electronic devices 1402 or 1404 each may be a device of the same or a different type from the electronic device 1401. According to an embodiment, all or some of operations to be executed at the electronic device 1401 may be executed at one or more of the external electronic devices 1402, 1404, or 1408. For example, if the electronic device 1401 should perform a function or a service automatically, or in response to a request from a user or another device, the electronic device 1401, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 1401. The electronic device 1401 may provide the outcome, with or without further processing of the outcome, as at least part of a reply to the request. To that end, a cloud computing, distributed computing, mobile edge computing (MEC), or client-server computing technology may be used, for example. The electronic device 1401 may provide ultra-low-latency services using, e.g., distributed computing or mobile edge computing. In another embodiment, the external electronic device 1404 may include an internet-of-things (IoT) device. The server 1408 may be an intelligent server using machine learning and/or a neural network. According to an embodiment, the external electronic device 1404 or the server 1408 may be included in the second network 1499. The electronic device 1401 may be applied to intelligent services (e.g., smart home, smart city, smart car, or healthcare) based on 5G communication technology or IoT-related technology.

According to an embodiment, an electronic device comprises a memory, a communication module, a first speaker including at least one vibration component, at least one first microphone, and a processor configured to output a first sound having a predetermined frequency via the first speaker when a closed space is formed with the electronic device mounted on a cradle, obtain a third sound, which is a reflection of the first sound in the closed space, via the at least one first microphone, obtain a fourth sound, which is a reflection of a second sound in the closed space, via the at least one first microphone, the second sound output from a second speaker included in an external electronic device located in the closed space, and identify whether the performance of the first speaker, the at least one first microphone, and the second speaker is normal, based on the third sound and the fourth sound.

The processor may be configured to obtain, from the external electronic device, information indicating whether the performance of the first speaker, the second speaker, and at least one second microphone included in the external electronic device is normal, as identified by the external electronic device and identify whether the performance of the first speaker, the at least one first microphone, the second speaker, and the at least one second microphone is normal, based on the obtained information.

The processor may be configured to compare a first signal corresponding to the third sound with a first reference signal in a frequency band corresponding to a specific foreign matter and compare a second signal corresponding to the fourth sound with a second reference signal and identify whether the performance of the first speaker, the at least one first microphone, the second speaker, and the at least one second microphone is normal, based on a result of the comparison.

The processor may be configured to determine that the performance of at least one of the at least one first microphone and the first speaker is normal, when a difference between the first signal and the first reference signal is smaller than a threshold, in the frequency band and determine that the performance of at least one of the at least one first microphone and the first speaker is abnormal, when the difference between the first signal and the first reference signal is larger than the threshold, in the frequency band.

The processor may be configured to determine that the performance of at least one of the at least one first microphone and the second speaker is normal, when a difference between the second signal and the second reference signal is smaller than a threshold, in the frequency band and determine that the performance of at least one of the at least one first microphone and the second speaker is abnormal, when the difference between the second signal and the second reference signal is larger than the threshold, in the frequency band.

The processor may be configured to determine that the specific foreign matter is present in at least one of the at least one first microphone and the second speaker when the difference between the second signal and the second reference signal is larger than the threshold.

The processor may be configured to identify attenuation and delay of the first signal for the first reference signal when the first signal and the first reference signal have similar forms and identify whether the performance of the first speaker, the at least one first microphone, the second speaker, and the at least one second microphone is normal, based on at least one of the attenuation and delay of the first signal.

The processor may be configured to identify whether the electronic device is worn by a user and when the electronic device is worn, output information as to whether the performance of the first speaker, the at least one first microphone, the second speaker, and the at least one second microphone is normal via the first speaker.

The processor may be configured to identify whether the cradle is in a closed state, with the electronic device mounted on the cradle and when the cradle is in the closed state, output the first signal having the predetermined frequency, via the first speaker.

The processor may be configured to obtain a waveform corresponding to a sound output from each of the first speaker and the second speaker, via the first microphone, with the cradle in the closed state, when the electronic device is first used and determine the first reference signal and the second reference signal based on the waveform.

The electronic device and the external electronic device may be implemented as a pair of earphones.

According to an embodiment, a method for operating an electronic device comprises outputting a first sound having a predetermined frequency via a first speaker included in the electronic device when a closed space is formed with the electronic device mounted on a cradle, obtaining a third sound, which is a reflection of the first sound in the closed space, via at least one first microphone included in the electronic device, obtaining a fourth sound, which is a reflection of a second sound in the closed space, via the at least one first microphone, the second sound output from a second speaker included in an external electronic device located in the closed space, and identifying whether the performance of the first speaker, the at least one first microphone, and the second speaker is normal, based on the third sound and the fourth sound.

The method may further comprise obtaining, from the external electronic device, information indicating whether the performance of the first speaker, the second speaker, and at least one second microphone included in the external electronic device is normal, as identified by the external electronic device and identifying whether the performance of the first speaker, the at least one first microphone, the second speaker, and the at least one second microphone is normal, based on the obtained information.

Identifying whether the performance of the first speaker, the at least one first microphone, the second speaker, and the at least one second microphone is normal may include comparing a first signal corresponding to the third sound with a first reference signal in a frequency band corresponding to a specific foreign matter, comparing a second signal corresponding to the fourth sound with a second reference signal in the frequency band, and identifying whether the performance of the first speaker, the at least one first microphone, the second speaker, and the at least one second microphone is normal, based on a result of the comparison.

Identifying whether the performance of the first speaker and the at least one first microphone is normal may include determining that the performance of at least one of the at least one first microphone and the first speaker is normal, when a difference between the first signal and the first reference signal is smaller than a threshold, in the frequency band and determining that the performance of at least one of the at least one first microphone and the first speaker is abnormal, when the difference between the first signal and the first reference signal is larger than the threshold, in the frequency band.

Identifying whether the performance of the first speaker, the at least one first microphone, the second speaker, and the at least one second microphone is normal may include determining that the performance of at least one of the at least one first microphone and the second speaker is normal, when a difference between the second signal and the second reference signal is smaller than a threshold, in the frequency band and determining that the performance of at least one of the at least one first microphone and the second speaker is abnormal, when the difference between the second signal and the second reference signal is larger than the threshold, in the frequency band.

The method may further comprise determining that the specific foreign matter is present in at least one of the at least one first microphone and the second speaker when the difference between the second signal and the second reference signal is larger than the threshold.

The method may further comprise identifying whether the electronic device is worn by a user and, when the electronic device is worn, outputting information as to whether the performance of the first speaker, the at least one first microphone, the second speaker, and the at least one second microphone is normal via the first speaker.

Outputting the first signal having the predetermined frequency may include identifying whether the cradle is in a closed state, with the electronic device mounted on the cradle and, when the cradle is in the closed state, outputting the first signal having the predetermined frequency.

Outputting the first signal having the predetermined frequency may include, when the cradle is in the closed state, outputting the first signal in response to a trigger signal received from an external terminal.

According to an embodiment, there is provided a computer-readable recording medium storing a program, the program comprising outputting a first sound having a predetermined frequency via a first speaker included in the electronic device when a closed space is formed with the electronic device mounted on a cradle, obtaining a third sound, which is a reflection of the first sound in the closed space, via at least one first microphone included in the electronic device, obtaining a fourth sound, which is a reflection of a second sound in the closed space, via the at least one first microphone, the second sound output from a second speaker included in an external electronic device located in the closed space, identifying whether the performance of the first speaker, the at least one first microphone, and the second speaker is normal, based on the third sound and the fourth sound, obtaining, from the external electronic device, information indicating whether the performance of the first speaker, the second speaker, and at least one second microphone included in the external electronic device is normal, as identified by the external electronic device, and identifying whether the performance of the first speaker, the at least one first microphone, the second speaker, and the at least one second microphone is normal, based on the obtained information.

The electronic device according to various embodiments may be one of various types of electronic devices. The electronic devices may include, for example, a portable communication device (e.g., a smart phone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 1440) including one or more instructions that are stored in a storage medium (e.g., internal memory 1436 or external memory 1438) that is readable by a machine (e.g., the electronic device 1401). For example, a processor (e.g., the processor 1420) of the machine (e.g., the electronic device 1401) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program products may be traded as commodities between sellers and buyers. The computer program product may be distributed in the form of a machine-readable storage medium (e.g., compact disc read only memory (CD-ROM)), or be distributed (e.g., downloaded or uploaded) online via an application store (e.g., Play Store™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. Some of the plurality of entities may be separately disposed in different components. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

As is apparent from the foregoing description, according to various embodiments, an electronic device may identify whether the performance of a speaker and microphone included in the electronic device is normal without the user's need for visiting a service center.

While the disclosure has been shown and described with reference to certain exemplary embodiments thereof, it will be understood by those skilled in the art that various changes in form and details may be made therein without departing from the spirit and scope of the disclosure as defined by the appended claims and their equivalents.

What is claimed is:

1. An electronic device, comprising:

a memory;

a communication module comprising communication circuitry;

a first speaker including at least one vibration component including circuitry;

at least one first microphone; and a processor configured to:

control the electronic device to output a first sound having a predetermined frequency via the first speaker when based on a closed space is being formed with the electronic device mounted on a cradle;

obtain a third sound, which is a reflection of the first sound in the closed space, via the at least one first microphone, the third sound being a reflection of the first sound in the closed space;

obtain a fourth sound, which is a reflection of a second sound in the closed space, via the at least one first microphone, the fourth sound being a reflection of a second sound in the closed space, the second sound output from a second speaker being included in an external electronic device located in the closed space; and identify whether a performance of the first speaker, the at least one first microphone, and the second speaker is normal, based on the third sound and the fourth sound.

2. The electronic device of claim 1, wherein the processor is configured to:

obtain, from the external electronic device, information indicating whether the performance of the first speaker, the second speaker, and at least one second microphone included in the external electronic device is normal, as identified by the external electronic device; and identify whether the performance of the first speaker, the at least one first microphone, the second speaker, and the at least one second microphone is normal, based on the obtained information.

3. The electronic device of claim 2, wherein the processor is configured to:

compare a first signal corresponding to the third sound with a first reference signal in a frequency band corresponding to a specific foreign matter and compare a second signal corresponding to the fourth sound with a second reference signal; and identify whether the performance of the first speaker, the at least one first microphone, the second speaker, and the at least one second microphone is normal, based on a result of the comparison.

4. The electronic device of claim 3, wherein the processor is configured to:

determine that the performance of at least one of the at least one first microphone and the first speaker is normal, when based on a difference between the first signal and the first reference signal is smaller being less than a threshold, in the frequency band; and determine that the performance of at least one of the at least one first microphone and the first speaker is abnormal, when based on the difference between the first signal and the first reference signal is larger being greater than the threshold, in the frequency band.

5. The electronic device of claim 3, wherein the processor is configured to:

determine that the performance of at least one of the at least one first microphone and the second speaker is normal, when based on a difference between the second signal and the second reference signal is smaller being less than a threshold, in the frequency band; and determine that the performance of at least one of the at least one first microphone and the second speaker is abnormal, when based on the difference between the second signal and the second reference signal is larger being greater than the threshold, in the frequency band.

6. The electronic device of claim 5, wherein the processor is configured to: determine that the specific foreign matter is present in at least one of the at least one first microphone and the second speaker when based on the difference between the second signal and the second reference signal is larger being greater than the threshold.

7. The electronic device of claim 3, wherein the processor is configured to:

identify attenuation and delay of the first signal for the first reference signal when based on the first signal and the first reference signal have having similar forms; and identify whether the performance of the first speaker, the at least one first microphone, the second speaker, and the at least one second microphone is normal, based on at least one of the attenuation and delay of the first signal.

8. The electronic device of claim 3, wherein the processor is configured to:

obtain a waveform corresponding to a sound output from each of the first speaker and the second speaker, via the first microphone, with the cradle in the closed state, when based on the electronic device is being first used; and determine the first reference signal and the second reference signal based on the waveform.

9. The electronic device of claim 2, wherein the processor is configured to:

identify whether the electronic device is worn by a user; and when based on the electronic device is being worn, output information as to indicating whether the performance of the first speaker, the at least one first microphone, the second speaker, and the at least one second microphone is normal, via the first speaker.

10. The electronic device of claim 1, wherein the processor is configured to:

identify whether the cradle is in a closed state, with the electronic device mounted on the cradle; and when based on the cradle is being in the closed state, output the first signal having the predetermined frequency, via the first speaker.

11. A method for operating an electronic device, the method comprising:

outputting a first sound having a predetermined frequency via a first speaker included in the electronic device when based on a closed space is being formed with the electronic device mounted on a cradle;

obtaining a third sound, which is a reflection of the first sound in the closed space, via at least one first microphone included in the electronic device, the third sound being a reflection of the first sound in the closed space;

obtaining a fourth sound, which is a reflection of a second sound in the closed space, via the at least one first microphone, the fourth sound being a reflection of a second sound in the closed space, the second sound output from a second speaker being included in an external electronic device located in the closed space; and identifying whether a performance of the first speaker, the at least one first microphone, and the second speaker is normal, based on the third sound and the fourth sound.

12. The method of claim 11, further comprising:

obtaining, from the external electronic device, information indicating whether the performance of the first speaker, the second speaker, and at least one second microphone included in the external electronic device is normal, as identified by the external electronic device; and identifying whether the performance of the first speaker, the at least one first microphone, the second speaker, and the at least one second microphone is normal, based on the obtained information.

13. The method of claim 12, wherein identifying whether the performance of the first speaker, the at least one first microphone, the second speaker, and the at least one second microphone is normal includes:

comparing a first signal corresponding to the third sound with a first reference signal in a frequency band corresponding to a specific foreign matter;

comparing a second signal corresponding to the fourth sound with a second reference signal in the frequency band; and identifying whether the performance of the first speaker, the at least one first microphone, the second speaker, and the at least one second microphone is normal, based on a result of the comparison.

14. The method of claim 13, wherein identifying whether the performance of the first speaker and the at least one first microphone is normal includes:

determining that the performance of at least one of the at least one first microphone and the first speaker is normal, when based on a difference between the first signal and the first reference signal is smaller being less than a threshold, in the frequency band; and determining that the performance of at least one of the at least one first microphone and the first speaker is abnormal, when based on the difference between the first signal and the first reference signal is larger being greater than the threshold, in the frequency band.

15. The method of claim 13, wherein identifying whether the performance of the first speaker, the at least one first microphone, the second speaker, and the at least one second microphone is normal includes:

determining that the performance of at least one of the at least one first microphone and the second speaker is normal, when based on a difference between the second signal and the second reference signal is smaller being less than a threshold, in the frequency band; and determining that the performance of at least one of the at least one first microphone and the second speaker is abnormal, when based on the difference between the second signal and the second reference signal is larger being greater than the threshold, in the frequency band.

* * * * *